US009925113B2

(12) United States Patent
Caberlotto et al.

(10) Patent No.: US 9,925,113 B2
(45) **Date of Patent: *Mar. 27, 2018**

(54) SYSTEMS AND METHODS FOR REGULATION OF ONE OR MORE EPIDERMAL OR DERMOEPIDERMAL PROTEINS

(71) Applicant: L'Oreal, Paris (FR)

(72) Inventors: Elisa Caberlotto, Paris (FR); Zane Bowman Allen Miller, Seattle, WA (US); Laetitia Ruiz, Bussy-Saint-Georges (FR); Aaron David Poole, Federal Way, WA (US); Gerald Keith Brewer, Redmond, WA (US)

(73) Assignee: L'Oreal, Paris (FR)

( * ) Notice: Subject to any disclaimer, the term of this patent is extended or adjusted under 35 U.S.C. 154(b) by 348 days.

This patent is subject to a terminal disclaimer.

(21) Appl. No.: 14/588,255

(22) Filed: Dec. 31, 2014

(65) Prior Publication Data

US 2016/0184177 A1 Jun. 30, 2016

(51) Int. Cl.
*A61H 7/00* (2006.01)
*A61H 15/00* (2006.01)
(Continued)

(52) U.S. Cl.
CPC ..... *A61H 15/0085* (2013.01); *A46B 13/008* (2013.01); *A46B 13/02* (2013.01);
(Continued)

(58) Field of Classification Search
CPC ..... A61H 7/00; A61H 7/005; A61H 23/02
See application file for complete search history.

(56) References Cited

U.S. PATENT DOCUMENTS 4,291,685 A 9/1981 Taelman
5,088,474 A 2/1992 Mabuchi et al.
(Continued)

FOREIGN PATENT DOCUMENTS

DE 20 2013 103 057 U1 9/2013
FR 2 992 856 A1 1/2014
(Continued)

OTHER PUBLICATIONS

Machine Translation of DE 20 2013 103 057, Koninklijke Philips N.V., patent date Sep. 12, 2017; machine translation obtained Mar. 13, 2017 from Espacenet.*
(Continued)

*Primary Examiner* — Justine Yu
*Assistant Examiner* — Kathrynn Lyddane
(74) *Attorney, Agent, or Firm* — Christensen O'Connor Johnson Kindness PLLC

(57) ABSTRACT

The disclosed embodiments provide skin stimulating devices and methods that address the aging effects of skin at a protein level. Particularly, cyclical mechanical strain is used to regulate specific proteins within the skin, so as to produce specific effects. As a non-limiting example, the disclosed embodiments can be used to increase the production of certain proteins (e.g., hyaluronan synthase 3 (HAS3); fibronectin; tropoelastin; procoll1; integrin, etc.) in the skin, which results in anti-aging effects by increasing epidermal cohesion.

9 Claims, 31 Drawing Sheets

(51) Int. Cl.
*A61H 23/02* (2006.01)
*A46B 13/00* (2006.01)
*A46B 13/02* (2006.01)

(52) U.S. Cl.
CPC ..... *A61H 7/005* (2013.01); *A61H 23/02* (2013.01); *A46B 2200/102* (2013.01); *A61H 2201/169* (2013.01); *A61H 2201/1685* (2013.01); *A61H 2201/1692* (2013.01); *A61H 2201/5007* (2013.01); *A61H 2201/5046* (2013.01); *A61H 2201/5058* (2013.01)

(56) References Cited

U.S. PATENT DOCUMENTS

| | | | | |
|---|---|---|---|---|
| 8,382,690 | B2 * | 2/2013 | Yoon | A61H 7/005 600/476 |
| 2002/0156402 | A1 | 10/2002 | Woog et al. | |
| 2005/0277950 | A1 * | 12/2005 | Pilcher | A61B 17/54 606/131 |
| 2005/0280319 | A1 * | 12/2005 | Pilcher | H02K 33/16 310/36 |
| 2008/0262397 | A1 | 10/2008 | Habatjou | |
| 2010/0222719 | A1 * | 9/2010 | Cowie | A61H 7/005 601/46 |
| 2011/0270137 | A1 * | 11/2011 | Goren | A61N 7/02 601/2 |
| 2013/0138023 | A1 | 5/2013 | Lerro | |
| 2014/0309662 | A1 * | 10/2014 | Brewer | A45D 34/042 606/131 |

FOREIGN PATENT DOCUMENTS

| | | | |
|---|---|---|---|
| GB | 385711 | | 1/1933 |
| JP | 2007-209533 | A | 8/2007 |
| JP | 2008-155115 | A | 7/2008 |

OTHER PUBLICATIONS

Farran, A.J.E., et al., "Design and Characterization of a Dynamic Vibrational Culture System," Journal of Tissue Engineering and Regenerative Medicine 7(3):213-225, Mar. 2013.

Gaston, J., et al., "The Response of Vocal Fold Fibroblasts and Mesenchymal Stromal Cells to Vibration," PLoS One 7(2):e30965, Feb. 2012, 9 pages.

Ito, Y., et al., "Nano-Vibration Effect on Cell Adhesion and Its Shape," Bio-Medical Materials and Engineering 21(3):149-158, 2011.

Kutty, J.K., and K. Webb, "Vibration Stimulates Vocal Mucosa-Like Matrix Expression by Hydrogel-Encapsulated Fibroblasts," Journal of Tissue Engineering and Regenerative Medicine 4(1):62-72, Jan. 2010.

Makous, J.C., et al., "A Critical Band Filter in Touch," Journal of Neuroscience 15(4):2808-2810, Apr. 1995.

Scheibert, J., et al., "The Role of Fingerprints in the Coding of Tactile Information Probed With a Biomimetic Sensor," Science 323(5920):1503-1506, Mar. 2009.

International Search Report and Written Opinion dated Jun. 15, 2016, issued in corresponding International Application No. PCT/US2015/067906, filed Dec. 29, 2015, 21 pages.

International Search Report and Written Opinion dated Mar. 17, 2016, issued in corresponding International Application No. PCT/US2015/065818, filed Dec. 15, 2015, 14 pages.

International Search Report and Written Opinion dated Mar. 17, 2016, issued in corresponding International Application No. PCT/US2015/065805, filed Dec. 15, 2015, 14 pages.

Invitation to Pay Additional Fees and Partial International Search dated Apr. 18, 2016, issued in corresponding International Application No. PCT/US2015/067906, filed Dec. 29, 2015, 8 pages.

International Search Report and Written Opinion dated Mar. 14, 2016, issued in corresponding International Application No. PCT/US2015/065799, filed Dec. 15, 2015, 15 pages.

* cited by examiner

| | Protein | Brush 40Hz | Brush 60Hz | Brush 90Hz | Brush 120Hz | Mia Brush (176hZ) |
|---|---|---|---|---|---|---|
| | | | | | | |
| Epidermis | CD44 | ↗ | ↗ | ↗ | ↗ | ↗ |
| | Filagrin | ↗ | ↗ | ↗ | ↗ | |
| | K10 | ↗ | ↗ | ↗ | ↗ | |
| | K14 | ↗ | ↗ | | ↗ | |
| | TGK 1 | | ↗ | | ↗ | ↗ |
| | Syndecan 1 | | ↗ | ↗ | ↗ | ↗ |
| | Tenacin C | | ↗ | ↗ | ↗ | ↗ |
| | ActinG/ActinF | ↗ | ↗ | ↗ | | ↗ |
| DEJ | Laminin V | | ↗ | ↗ | | ↗ |
| | Coll 4 | ↗ | ↗ | ↗ | ↗ | |
| | Coll 7 | | ↗ | ↗ | ↗ | ↗ |
| | Perlecan | | ↗ | ↗ | | |
| Dermis | Fibronectin | | ↗ | ↗ | | |
| | Procoll 1 | | ↗ | ↗ | ↗ | ↗ |
| | Tropoelastin | | ↗ | ↗ | | ↗ |
| | HAS 3 | ↗ | ↗ | ↗ | | |
| | Decorin | | | | | |
| | Integrinβ | ↗ | ↗ | ↗ | ↗ | |
| Soluble Factors | MMP1 | ↗ | | | | ↗ |

High Upregulation
Low Upregulation
Medium Upregulation

40Hz:
Surface effect
- Epidermal renewel (K10, K14, filagrin)
- Increase epidermal thickness 60Hz:
Global effect on different skin layers:
- Epidermal diff and cohesion
- Improve DEJ cohesion
- ECM production and integrin expression increased 90Hz:
Global effect on different skin layers:
- Epidermal cohesion
- Improve collagen production in DEJ
- ECM production 120Hz:
Global effect at epidermal and DEJ level:
- Improve collagen production in DEJ

*FIG. 2*

SYSTEMS AND METHODS FOR REGULATION OF ONE OR MORE EPIDERMAL OR DERMOEPIDERMAL PROTEINS

CROSS REFERENCES TO RELATED APPLICATIONS

The present application is related to U.S. patent application Ser. No. 14/587,587, entitled "ANTI-AGING APPLICATOR," filed Dec. 31, 2014, to U.S. patent application Ser. No. 14/588,209, entitled "SYSTEMS AND METHODS FOR REGULATION OF ONE OR MORE EPIDERMAL PROTEINS," filed Dec. 31, 2014, and to U.S. patent application Ser. No. 14/588,230, entitled "SYSTEMS AND METHODS FOR REGULATION OF ONE OR MORE CUTANEOUS PROTEINS," filed Dec. 31, 2014, the contents of which are hereby incorporated by reference in their entirety.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In one aspect, a method for modulating one or more cutaneous proteins is provided. In one embodiment, the method includes:

applying a mechanical strain to a portion of skin of a character and for a duration sufficient to affect upregulation of one or more epidermis-associated proteins or dermoepidermal-junction-associated proteins without substantially affecting upregulation of one or more or dermis-associated proteins in the portion of skin.

In an embodiment, applying the mechanical strain to a portion of skin includes applying a cyclical mechanical strain having a peak cyclic or oscillation frequency ranging from about 100 hertz to about 140 hertz for a duration sufficient to affect upregulation of one or more epidermis-associated proteins or dermoepidermal-junction-associated proteins without substantially affecting upregulation of one or more or dermis-associated proteins in the portion of skin.

In one aspect, an appliance is provided. In one embodiment, the appliance includes:

a cyclical mechanical strain component configured to cause induction of mechanical strain within a portion of skin sufficient to modulate one or more cutaneous proteins;

wherein the cyclical mechanical strain component is configured to apply a mechanical strain to a portion of skin of a character and for a duration sufficient to affect upregulation of one or more epidermis-associated proteins or dermoepidermal-junction-associated proteins without substantially affecting upregulation of one or more or dermis-associated proteins in the portion of skin.

In an embodiment, applying the mechanical strain to a portion of skin includes applying a cyclical mechanical strain having a peak cyclic or oscillation frequency ranging from about 100 hertz to about 140 hertz for a duration sufficient to affect upregulation of one or more epidermis-associated proteins or dermoepidermal-junction-associated proteins without substantially affecting upregulation of one or more or dermis-associated proteins in the portion of skin.

In one aspect, an anti-aging circuit is provided that is configured to generate one or more control commands for controlling and powering the cyclical mechanical strain component. In one embodiment, the anti-aging circuit is operably couplable to an appliance configured to cause induction of mechanical strain within a portion of skin sufficient to modulate one or more cutaneous proteins.

DESCRIPTION OF THE DRAWINGS

The foregoing aspects and many of the attendant advantages of the disclosed embodiments will become more readily appreciated as the same become better understood by reference to the following detailed description, when taken in conjunction with the accompanying drawings, wherein:

FIG. 2 summarizes experimental data illustrating the regulation of cutaneous proteins in accordance with the disclosed embodiments;

DETAILED DESCRIPTION

Figure 1:
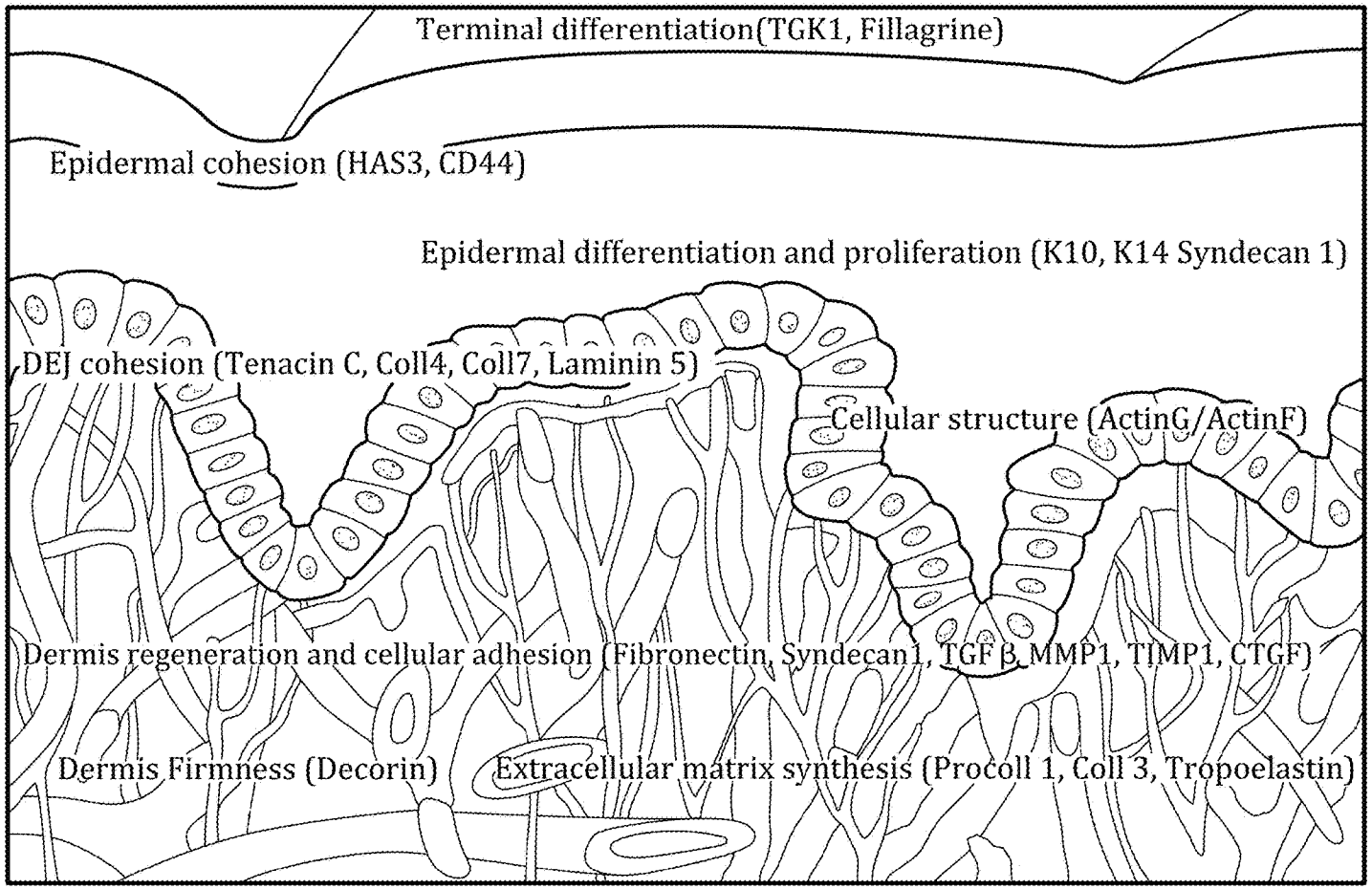
FIG. 1 is a diagrammatic representation of human skin, including certain cutaneous proteins.

As a person ages, the mechanical and visual characteristics of the skin change. With time, epidermal differentiation is reduced, cells are renewed more slowly, cohesion is reduced at the dermoepidermal junction (DEJ), and at the dermal level the structural protein fibers that impart elasticity and firmness (such as collagen and elastin) become fragmented and less numerous. The result is a loss of skin elasticity and resilience as well as a loss of color homogeneity and dulling of the complexion.

While skin treatments have been proposed to fight these aging effects, no compelling solutions exist.

In an embodiment, disclosed technologies and methodologies provide skin stimulating appliances and methods that address the aging effects of skin at a protein level. For example, in an embodiment, technologies and methodologies employing cyclical mechanical strain are used to regulate specific proteins within the skin, so as to produce specific effects, including, among other things, reduction of terminal differentiation, increasing cohesion, reduction of epidermal renewal, reduction of DEJ cohesion, and reduction of extracellular matrix proteins (ECM).

In an embodiment, the cumulative effects of applying cyclical mechanical strain as disclosed include one or more anti-aging effects. For example, by applying a particular stress to the skin, cutaneous cells will react to the stress by upregulating (increasing) production of certain proteins. The type of stress applied to the skin will affect the location within the skin where the cells are stresses. Furthermore, the character and duration of the stress will affect which proteins are upregulated and to what extent. As a non-limiting example of the benefits achievable, certain disclosed embodiments can be used to upregulate the production of integrin in the skin, which results in anti-aging effects by increasing epidermal cohesion.

According to the disclosed embodiments it has been determined that a number of proteins within the skin can be regulated using, among other things, cyclical mechanical strain applied at particular frequencies (e.g., via an end effector, via an oscillating brush, and the like). The disclosed embodiments employ technologies and methodologies that stimulate frequency response of cells in the dermis and epidermis to induce production of proteins associated with young, healthy skin. Human skin cells (dermal fibroblasts in particular) respond to strain in tissue with cytoskeletal reordering and increased production in extracellular matrix proteins. Many cells in the body (cells of the inner ear for example) have mechanical receptors in their cell membranes that respond to stimulation at specific cyclic frequencies. In an embodiment, by combining discrete, differential strain in the skin at specific frequencies, the disclosed technologies and methodologies induce increased growth and repair activities from multiple cell types found in the skin, thereby producing an anti-aging effect.

Generally, methods are disclosed for modulating (e.g., upregulating) one or more cutaneous proteins. The methods include applying a cyclical mechanical strain to a portion of skin. The cyclical mechanical strain is of a character and for a duration sufficient to affect upregulation of one or more cutaneous proteins. Depending on the character of the cyclical mechanical strain, particularly a peak oscillation frequency, cutaneous proteins are selectively upregulated or not substantially upregulated. Appliances for implementing the methods are also provides, along with circuitry configured to instruct an appliance to implement the methods.

In certain embodiments, the result of the method is an anti-aging effect on the portion of skin. In this regard, certain beneficial cutaneous proteins are selectively upregulate, while non-beneficial (or less-beneficial or even detrimental) cutaneous proteins are not substantially upregulated.

The disclosed embodiments are directed to one or more of three particular areas of the skin including the epidermis, DEJ, and dermis, each of which have their own associated proteins, as disclosed specifically in FIGS. 1 and 2, and summarized as follows.

Epidermis-associated proteins include filaggrin; transglutaminase 1 (TGK1); glycoprotein (CD44); keratin 10 (K10); keratin 14 (K14); tenacin C; globular actin (ActinG); fibrillar actin (ActinF); and syndecan 1.

Dermoepidermal-junction-associated proteins include collagen 4 (Coll 4); collagen 7 (Coll 7); laminin V; and perlecan.

Dermis-associated proteins include hyaluronan synthase 3 (HAS3); fibronectin; tropoelastin; procoll1; integrin; and decorin.

One further cutaneous protein that can be modulated according to the disclosed embodiments, which is not associated with any single layer of skin, is matrix metalloproteinase-1 (MMP1). MMP1 is a detrimental protein that is known to break down collagen. Accordingly, upregulation of MMP1 is traditionally considered detrimental in skin.

The cutaneous proteins of interest provide different qualities to the skin. A few examples are as follows.

Hyaluronic acid (HAS3) and receptor (CD44) are down regulated during aging and menopause; therefore, their upregulation is considered anti-aging by acting against the atrophy of the epidermis and the dermis.

Reduction of the possibility of developing eczema, asthma, and cutaneous allergies results from upregulation of Filaggrin. Perturbation of skin barrier function as a result of reduction or complete loss of filaggrin expression leads to enhanced percutaneous transfer of allergens. Filaggrin is therefore a primary cutaneous defense mechanism, and protects the body from the entry of foreign environmental substances that can otherwise trigger aberrant immune responses.

Regulation of cell adhesion by upregulation of integrin β1 and Syndecan 1.

Promoting the spread of platelets at the site of injury, the adhesion and migration of neutrophils, monocytes, fibroblasts, and endothelial cells into the wound region, and the migration of epidermal cells through granulation of tissue due to upregulation of Fibronectin.

Improved wound healing due to upregulation of Fibronectin and Tenacin C.

Increasing the elasticity of the skin due to upregulation of Tropoelestin and Coll 4.

Reinforcement of the basement membrane by upregulating both Laminin V and Coll 4. The basement membrane acts as a mechanical barrier, preventing malignant cells from invading the deeper tissues.

Preventing cellular proliferation of tumor cell lines by upregulating Syndecan (for example, in the epithelial-derived tumor cell line, S115, the syndecan 1 ectodomain suppresses the growth of S115 cells without affecting the growth of normal epithelial cells (Zhang Y et al., *The Journal of Biological Chemistry* 2013)).

Regulation of cell adhesion by upregulating both Integrinβ1 and Syndecan 1.

As used herein, the terms "protein," "biomarker," and "marker" are used synonymously to describe the cutaneous proteins related to the disclosed embodiments.

One feature that differentiates certain embodiments disclosed herein is the peak frequency of the cyclical mechanical strain. When the cyclical mechanical strain includes oscillation, the peak frequency is a peak oscillation frequency (POF) of the cyclical mechanical strain. Particularly, it has been experimentally determined (as summarized in FIG. 2) that different POF ranges affect cutaneous proteins in different areas and to different degrees.

In one embodiment, POF in the "low-frequency" range of about 30 hertz to about hertz primarily affects epidermis-associated proteins without substantially upregulating dermoepidermal-junction-associated proteins, and dermis-associated proteins, as illustrated by the data in the "Brush 40 Hz" column of FIG. 2. In one embodiment, POF in the "mid-frequency" range of about 50 hertz to about 100 hertz affects all three layers of cutaneous proteins: epidermis-associated proteins, dermoepidermal-junction-associated proteins, and dermis-associated proteins, as illustrated by the data in the "Brush 60 Hz" and "Brush 90 Hz" columns of FIG. 2. In one embodiment, POF in the "high-frequency"

range of about 100 hertz to about 140 hertz affects epidermis-associated proteins and dermoepidermal-junction-associated proteins, but does not substantially affect dermis-associated proteins, as illustrated by the data in the "Brush 120 Hz" column of FIG. 2.

As used herein, the term "about," when used to modify a value, indicates that the value can be raised or lowered by 5% and remain within the disclosed embodiment.

As used herein, the term "does not substantially affect" in the context of cutaneous proteins indicates that two or fewer associated proteins are upregulated. For example, the low-frequency POF results in FIG. 2 demonstrate that one DEJ-associated protein (Coll 4) and two dermis-associated proteins (HAS 3 and Integrin) are upregulated; however, because so few proteins associated with the DEJ and dermis are upregulated, the low-frequency POF method is deemed to not substantially affect upregulation of DEJ-associated or dermis-associated proteins.

The particular aspects and embodiments related to low-frequency, mid-frequency, and high-frequency peak oscillation frequencies will be described individually in further detail below. Common elements related to methods, apparatuses, and other aspects disclosed herein will now be described. Accordingly, these principles can be applied to operation at any frequency.

In one embodiment, applying the mechanical strain to a portion of skin includes applying an application force normal to the portion of skin and applying a mechanical shear force in a plane of the portion of skin. In this regard, the normal application force acts to contact the source of mechanical strain to the portion of skin and the mechanical shear force provides the cyclical mechanical strain. An example of this embodiment is the use of a brush or end effector workpiece, as disclosed in the examples herein.

In one embodiment, applying the mechanical strain to a portion of skin includes the duration being about 1 minute to about 60 minutes. The duration ranges from 1 minute to 30 minutes in one embodiment. The duration ranges from about 1 minute to about 10 minutes in one embodiment. The duration ranges from about 1 minute to about 5 minutes in one embodiment. The duration is greater than about 2 minutes in one embodiment. As discussed in further detail below, the duration of application of the mechanical strain is controlled by an appliance (e.g., through circuitry) in certain embodiments.

The methods disclosed herein operate optimally when the mechanical strain is applied substantially continuously in substantially the same portion of skin. This operating principle allows for sufficient stimulation forces to operate on the cutaneous cells targeted. A combination of time and concentrated location produces the desired upregulation. Accordingly, in one embodiment, applying the mechanical strain to a portion of skin includes applying the mechanical strain to the portion of skin without substantial interruption (e.g., without greater than a one second break) during the treatment time period.

In one embodiment, the method includes applying the cyclical mechanical strain to cause induction of mechanical strain having at least two different characteristics within the portion of skin sufficient to modulate one or more cutaneous proteins.

In an embodiment, applying the mechanical strain to a portion of skin includes activating two or more treatment operations. For example, in an embodiment, applying the mechanical strain to a portion of skin includes two or more treatment operations selected from the group consisting of:

applying a cyclical mechanical strain having a peak oscillation frequency ranging from about 30 hertz to about 50 hertz for a duration sufficient to affect upregulation of one or more epidermis-associated proteins without substantially affecting upregulation of dermoepidermal-junction-associated proteins or dermis-associated proteins in the portion of skin;

applying a cyclical mechanical strain having a peak cyclic or oscillation frequency ranging from about 50 hertz to about 100 hertz for a duration sufficient to affect upregulation of one or more epidermis-associated proteins, one or more dermoepidermal-junction-associated proteins, and one or more dermis-associated proteins in the portion of skin; and applying a cyclical mechanical strain having a peak cyclic or oscillation frequency ranging from about 100 hertz to about 140 hertz for a duration sufficient to affect upregulation of one or more epidermis-associated proteins or dermoepidermal-junction-associated proteins without substantially affecting upregulation of dermis-associated proteins in the portion of skin.

In an embodiment, applying the mechanical strain to the portion of skin includes concurrently or sequentially activating two or more treatment operations. For example, in one embodiment, a first peak cyclic or oscillation frequency is applied for a first treatment period and then a second peak cyclic or oscillation frequency is applied for a second treatment period. Further treatment periods of different or similar character are included in further embodiments. Such a multi-part treatment allows a user to benefit from protein upregulation from two or more frequencies.

In an embodiment, applying the mechanical strain to the portion of skin includes generating a spatially patterned stimulus having at least a first region and a second region, the second region having at least one of a an intensity, a phase, an amplitude, a pulse frequency, a peak cyclic frequency, or power distribution different from the first region In an embodiment, the described technologies and methodologies include the application of two or more frequencies concurrently.

Low-Frequency Strain

In an embodiment, a peak cyclic or oscillation frequency is in the "low-frequency" range of about 30 hertz to about 50 hertz. This POF primarily affects epidermis-associated proteins without substantially upregulating dermoepidermal-junction-associated proteins, and dermis-associated proteins, as illustrated by the data in the "Brush 40 Hz" column of FIG. 2.

Accordingly, in one aspect, a method for modulating one or more cutaneous proteins is provided. In one embodiment, the method includes:

applying a mechanical strain to a portion of skin of a character and for a duration sufficient to affect upregulation of one or more epidermis-associated proteins without substantially affecting upregulation of one or more dermoepidermal-junction-associated proteins or dermis-associated proteins in the portion of skin.

In an embodiment, applying the mechanical strain to a portion of skin includes applying a cyclical mechanical strain having a peak cyclic or oscillation frequency ranging from about 30 hertz to about 50 hertz for a duration sufficient to affect upregulation of one or more epidermis-associated proteins without substantially affecting upregulation of one or more dermoepidermal-junction-associated proteins or dermis-associated proteins in the portion of skin.

The methods and appliances disclosed elsewhere herein are all applicable and related to the low-frequency aspects and embodiments.

In one embodiment, the peak cyclic or oscillation frequency is about 40 hertz.

In one embodiment, applying the mechanical strain to a portion of skin includes applying a cyclical mechanical strain having a peak cyclic or oscillation frequency ranging from about 30 hertz to about 50 hertz for a duration sufficient to affect upregulation of one or more epidermis-associated proteins selected from the group consisting of filaggrin; transglutaminase 1 (TGK1); glycoprotein (CD44); keratin 10 (K10); keratin 14 (K14); tenacin C; globular actin (ActinG); fibrillar actin (ActinF); and syndecan 1; without substantially affecting upregulation of one or more dermoepidermal junction proteins selected from the group consisting of collagen 4 (Coll 4); collagen 7 (Coll 7); laminin V; and perlecan; and without substantially affecting upregulation of one or more dermis-associated proteins selected from the group consisting of hyaluronan synthase 3 (HAS3); fibronectin; tropoelastin; procoll1; integrin; and decorin.

In one embodiment, applying the mechanical strain to a portion of skin includes applying a cyclical mechanical strain having a peak cyclic or oscillation frequency ranging from about 30 hertz to about 50 hertz for a duration sufficient to affect upregulation of one or more epidermis-associated proteins selected from the group consisting of filaggrin; glycoprotein (CD44); keratin 10 (K10); keratin 14 (K14); globular actin (ActinG); and fibrillar actin (ActinF); without substantially affecting upregulation of one or more dermoepidermal-junction-associated proteins selected from the group consisting of collagen 7 (Coll 7); laminin V; and perlecan; and without substantially affecting upregulation of one or more dermis-associated proteins selected from the group consisting of fibronectin; tropoelastin; procoll1; and decorin.

Mid-Frequency Strain

As mentioned above, in one embodiment the peak cyclic or oscillation frequency is in the "mid-frequency" range of about 50 hertz to about 100 hertz. This POF affects epidermis-associated proteins, dermoepidermal-junction-associated proteins, and dermis-associated proteins (i.e., all three skin layers), as illustrated by the data in the "Brush 60 Hz" and "Brush 90 Hz" column of FIG. 2. Accordingly, this POF range has been experimentally determined to provide the most significant upregulation of the proteins of interest in all three layers of skin.

Accordingly, in one aspect, a method for modulating one or more cutaneous proteins is provided. In one embodiment, the method includes:

applying a mechanical strain to a portion of skin of a character and for a duration sufficient to affect upregulation of one or more cutaneous proteins in the portion of skin.

In an embodiment, applying the mechanical strain to a portion of skin includes applying a cyclical mechanical strain having a peak cyclic or oscillation frequency ranging from about 50 hertz to about 100 hertz for a duration sufficient to affect upregulation of one or more cutaneous proteins in the portion of skin.

The methods and appliances disclosed elsewhere herein are all applicable and related to the mid-frequency aspects and embodiments.

In one embodiment, the peak cyclic or oscillation frequency is about 60 hertz. In one embodiment, the peak cyclic or oscillation frequency is about 90 hertz.

In one embodiment, applying the mechanical strain to a portion of skin includes applying a cyclical mechanical strain having a peak cyclic or oscillation frequency ranging from about 50 hertz to about 100 hertz for a duration sufficient to affect upregulation of one or more epidermis-associated proteins selected from the group consisting of filaggrin; transglutaminase 1 (TGK1); glycoprotein (CD44); keratin 10 (K10); keratin 14 (K14); tenacin C; globular actin (ActinG); fibrillar actin (ActinF); and syndecan 1.

In a further embodiment, applying the mechanical strain to a portion of skin includes applying a cyclical mechanical strain having a peak cyclic or oscillation frequency ranging from about 50 hertz to about 100 hertz for a duration sufficient to affect upregulation of one or more dermoepidermal junction proteins selected from the group consisting of collagen 4 (Coll 4); collagen 7 (Coll 7); laminin V; and perlecan.

In a further embodiment, applying the mechanical strain to a portion of skin includes applying a cyclical mechanical strain having a peak cyclic or oscillation frequency ranging from about 50 hertz to about 100 hertz for a duration sufficient to affect upregulation of one or more dermis-associated proteins selected from the group consisting of hyaluronan synthase 3 (HAS3); fibronectin; tropoelastin; procoll1; and integrin. In one embodiment decorin is not substantially upregulated.

In one embodiment MMP1 is not substantially upregulated.

High-Frequency Strain

As mentioned above, in one embodiment the peak cyclic or oscillation frequency is in the "high-frequency" range of about 100 hertz to about 140 hertz. This POF primarily affects epidermis-associated proteins and dermoepidermal-junction-associated proteins without substantially upregulating dermis-associated proteins, as illustrated by the data in the "Brush 120 Hz" column of FIG. 2.

Accordingly, in one aspect, a method for modulating one or more cutaneous proteins is provided. In one embodiment, the method includes:

applying a mechanical strain to a portion of skin of a character and for a duration sufficient to affect upregulation of one or more epidermis-associated proteins or dermoepidermal-junction-associated proteins without substantially affecting upregulation of one or more or dermis-associated proteins in the portion of skin.

In an embodiment, applying the mechanical strain to a portion of skin includes applying a cyclical mechanical strain having a peak cyclic or oscillation frequency ranging from about 100 hertz to about 140 hertz for a duration sufficient to affect upregulation of one or more epidermis-associated proteins or dermoepidermal-junction-associated proteins without substantially affecting upregulation of one or more or dermis-associated proteins in the portion of skin.

The methods and appliances disclosed elsewhere herein are all applicable and related to the low-frequency aspects and embodiments.

In one embodiment, the peak cyclic or oscillation frequency is about 120 hertz.

In one embodiment, applying the mechanical strain to a portion of skin includes applying a cyclical mechanical strain having a peak cyclic or oscillation frequency ranging from about 100 hertz to about 140 hertz for a duration sufficient to affect upregulation of one or more epidermis-associated proteins or dermoepidermal-junction-associated proteins selected from the group consisting of filaggrin; transglutaminase 1 (TGK1); glycoprotein (CD44); keratin 10 (K10); keratin 14 (K14); tenacin C; globular actin (ActinG); fibrillar actin (ActinF); syndecan 1; collagen 4 (Coll 4); collagen 7 (Coll 7); laminin V; and perlecan; without substantially affecting upregulation of one or more dermis-associated proteins selected from the group consisting of hyaluronan synthase 3 (HAS3); fibronectin; tropoelastin; procoll1; integrin; and decorin.

In one embodiment, applying the mechanical strain to a portion of skin includes applying a cyclical mechanical strain having a peak cyclic or oscillation frequency ranging from about 100 hertz to about 140 hertz for a duration sufficient to affect upregulation of one or more epidermis-associated or dermoepidermal-junction-associated proteins selected from the group consisting of filaggrin; transglutaminase 1 (TGK1); glycoprotein (CD44); keratin 10 (K10); keratin 14 (K14); tenacin C; syndecan 1; collagen 4 (Coll 4); and collagen 7 (Coll 7); without substantially affecting upregulation of one or more dermis-associated proteins selected from the group consisting of hyaluronan synthase 3 (HAS3); fibronectin; tropoelastin; and decorin.

In one embodiment MMP1 is not substantially upregulated.

Appliances

Appliances (e.g., powered brushes) are one class of apparatus that can be used to perform the disclosed methods.

In certain embodiments, applying the mechanical strain to a portion of skin includes using an appliance having a source of motion coupled to a workpiece configured to contact the portion of skin and apply a cyclical mechanical strain. Any source of motion (e.g., motor) can be used in any combination with a workpiece, as long as an appropriate mechanical strain can be applied that is sufficient to produce the advantageous effects disclosed herein.

The cyclical mechanical strain applied cycles through at least one common position during operation. Accordingly, in one embodiment applying the mechanical strain to a portion of skin includes moving the workpiece in a motion selected from the group consisting of oscillation, vibration, reciprocation, rotation, cyclical, and combinations thereof. In one embodiment applying the mechanical strain to a portion of skin includes moving the workpiece in an angular oscillatory motion.

In one embodiment, applying the mechanical strain to a portion of skin includes the portion of skin being substantially equal in size to a contact area of the workpiece configured to contact the portion of skin.

In one embodiment, applying the mechanical strain to a portion of skin includes the workpiece being selected from the group consisting of a brush, an applicator, and an end effector. Brushes of any size and composition can be used. Exemplary brushes are those sold by Clarisonic for use with its cleansing appliances. An exemplary brush-based workpiece is described in detail below. Applicators of any type can be used. Exemplary applicators include elastomeric applicators and formulation applicators. End effectors are specifically designed to apply an optimized cyclical mechanical strain in accordance with the disclosed embodiments. A representative end effector is described in further detail below.

In one aspect, an appliance is provided. In one embodiment, related to the low-frequency embodiments disclosed herein, the appliance includes:

a cyclical mechanical strain component configured to cause induction of mechanical strain within a portion of skin sufficient to modulate one or more cutaneous proteins;

wherein the cyclical mechanical strain component is configured to apply a mechanical strain to a portion of skin of a character and for a duration sufficient to affect upregulation of one or more epidermis-associated proteins without substantially affecting upregulation of one or more dermis-associated proteins in the portion of skin.

In an embodiment, applying the mechanical strain to a portion of skin includes applying a cyclical mechanical strain having a peak cyclic or oscillation frequency ranging from about 30 hertz to about 50 hertz for a duration sufficient to affect upregulation of one or more epidermis-associated proteins without substantially affecting upregulation of one or more dermoepidermal-junction-associated proteins or dermis-associated proteins in the portion of skin.

In one embodiment, related to the mid-frequency embodiments disclosed herein, the appliance includes:

a cyclical mechanical strain component configured to cause induction of mechanical strain within a portion of skin sufficient to modulate one or more cutaneous proteins, In an embodiment, the cyclical mechanical strain component is configured to apply a mechanical strain to a portion of skin of a character and for a duration sufficient to affect upregulation of one or more epidermis-associated proteins, dermoepidermal-junction-associated proteins, or dermis-associated proteins in the portion of skin.

In an embodiment, applying the mechanical strain to a portion of skin includes applying a cyclical mechanical strain having a peak cyclic or oscillation frequency ranging from about 50 hertz to about 100 hertz for a duration sufficient to affect upregulation of one or more epidermis-associated proteins, dermoepidermal-junction-associated proteins, or dermis-associated proteins in the portion of skin.

In one embodiment, related to the high-frequency embodiments disclosed herein, the appliance includes:

a cyclical mechanical strain component configured to cause induction of mechanical strain within a portion of skin sufficient to modulate one or more cutaneous proteins.

In an embodiment, the cyclical mechanical strain component is configured to apply a mechanical strain to a portion of skin of a character and for a duration sufficient to affect upregulation of one or more epidermis-associated proteins or dermoepidermal-junction-associated proteins without substantially upregulating one or more dermis-associated proteins in the portion of skin. For example, during operation, an end effector with a plurality of contact points contacts a portion of skin and delivers a cyclical mechanical strain that, in turn, stimulates a standing wave within the portion of the skin.

In an embodiment, applying the mechanical strain to a portion of skin includes applying a cyclical mechanical strain having a peak cyclic or oscillation frequency ranging from about 100 hertz to about 140 hertz for a duration sufficient to affect upregulation of one or more epidermis-associated proteins or dermoepidermal-junction-associated proteins without substantially upregulating one or more dermis-associated proteins in the portion of skin.

In one embodiment, the cyclical mechanical strain component includes circuitry operably coupled to an end effector configured to cause induction of mechanical strain within a portion of skin sufficient to modulate one or more cutaneous proteins.

In one embodiment, the cyclical mechanical strain component includes circuitry configured to vary a duty cycle associated with causing the induction of mechanical strain within a portion of skin sufficient to modulate one or more cutaneous proteins.

In one embodiment, the cyclical mechanical strain component includes a source of motion coupled to a workpiece that is configured to contact the portion of skin, wherein the source of motion and the workpiece are configured to cause induction of mechanical strain within the portion of skin sufficient to modulate one or more cutaneous proteins. In this regard, the exemplary embodiments of the brush and end-effector include motors as the source of motion. In one embodiment, the workpiece is selected from the group consisting of a brush, an applicator, and an end effector.

Any motion resulting in a cyclic mechanical strain can be incorporated into the appliance. In one embodiment, the appliance is configured to move the workpiece in a motion selected from the group consisting of oscillation, vibration, reciprocation, rotation, cyclical, and combinations thereof.

In one embodiment, the appliance is configured to move the workpiece in an angular oscillatory motion, as described in further detail with regard to the exemplary embodiments below. In one embodiment, the angular oscillatory motion includes an amplitude of about 3 degrees to about 17 degrees. In one embodiment the amplitude is about 8 degrees, which is the standard amplitude of a Clarisonic powered appliance.

In one embodiment, the duration sufficient to affect upregulation of one or more epidermis-associated proteins without substantially affecting upregulation of one or more dermoepidermal-junction-associated proteins or dermis-associated proteins in the portion of skin is about 1 minute to about 60 minutes. In one embodiment, the appliance is configured to cease induction of mechanical strain within the portion of skin after the duration sufficient to affect upregulation of one or more epidermis-associated proteins without substantially affecting upregulation of one or more dermoepidermal-junction-associated proteins or dermis-associated proteins in the portion of skin. Accordingly, in one embodiment, the appliance is configured to shut off power to, or otherwise cease operation of the appliance to the extent that it provides a cyclical mechanical strain. The duration of this treatment period is adjustable in certain embodiments. The duration ranges from about 1 minute to about 60 minutes in one embodiment. The duration ranges from about 1 minute to about 30 minutes in one embodiment. The duration ranges from about 1 minute to about 10 minutes in one embodiment. The duration ranges from about 1 minute to about 5 minutes in one embodiment. The duration is greater than about 2 minutes in one embodiment.

In one embodiment, the appliance further includes a user-activated input configured to activate the cyclical mechanical strain component for a treatment time period at the peak cyclic or oscillation frequency. The user-activated input can be any mechanism for providing input sufficient to control operation of the appliance. In one embodiment the user-activated input is a button or buttons. In one embodiment the user-activated input is touch screen including at least one icon.

The appliance can also be configured to control the character of the cyclical mechanical strain. In one embodiment, the user-activated input is configured to control an amplitude of an angular oscillatory motion of a workpiece.

In one embodiment, the appliance includes circuitry configured to generate one or more control commands for controlling and powering the cyclical mechanical strain component In one embodiment, the circuitry is configured to instruct the cyclical mechanical strain component to cause induction of mechanical strain within the portion of skin sufficient to modulate one or more cutaneous proteins.

In one embodiment, the circuitry is configured to instruct the cyclical mechanical strain component to cause induction of mechanical strain having at least two different characteristics within the portion of skin sufficient to modulate one or more cutaneous proteins.

In an embodiment, applying the mechanical strain to a portion of skin includes two or more treatment operations selected from the group consisting of:

applying a cyclical mechanical strain having a peak cyclic or oscillation frequency ranging from about 30 hertz to about 50 hertz for a duration sufficient to affect upregulation of one or more epidermis-associated proteins without substantially affecting upregulation of dermoepidermal-junction-associated proteins or dermis-associated proteins in the portion of skin;

applying a cyclical mechanical strain having a peak cyclic or oscillation frequency ranging from about 50 hertz to about 100 hertz for a duration sufficient to affect upregulation of one or more epidermis-associated proteins, one or more dermoepidermal-junction-associated proteins, and one or more dermis-associated proteins in the portion of skin; and applying a cyclical mechanical strain having a peak cyclic or oscillation frequency ranging from about 100 hertz to about 140 hertz for a duration sufficient to affect upregulation of one or more epidermis-associated proteins or dermoepidermal-junction-associated proteins without substantially affecting upregulation of dermis-associated proteins in the portion of skin.

In a further embodiment, the circuitry is configured to instruct the cyclical mechanical strain component to apply the mechanical strain to the portion of skin including the two or more treatment operations being applied in a in a manner selected from the group consisting of sequentially, concurrently, and combinations thereof. For example, in one embodiment, the circuitry is configured to provide instructions to an appliance to sequentially apply a first peak cyclic or oscillation frequency for a first treatment period and then apply a second peak cyclic or oscillation frequency for a second treatment period. Further treatment periods of different or similar character are included in further embodiments. Such a multi-part treatment allows a user to benefit from protein upregulation from two or more frequencies.

In an embodiment, the described technologies and methodologies include the circuitry being configured to apply two or more frequencies concurrently.

Brushes

Figure 3:
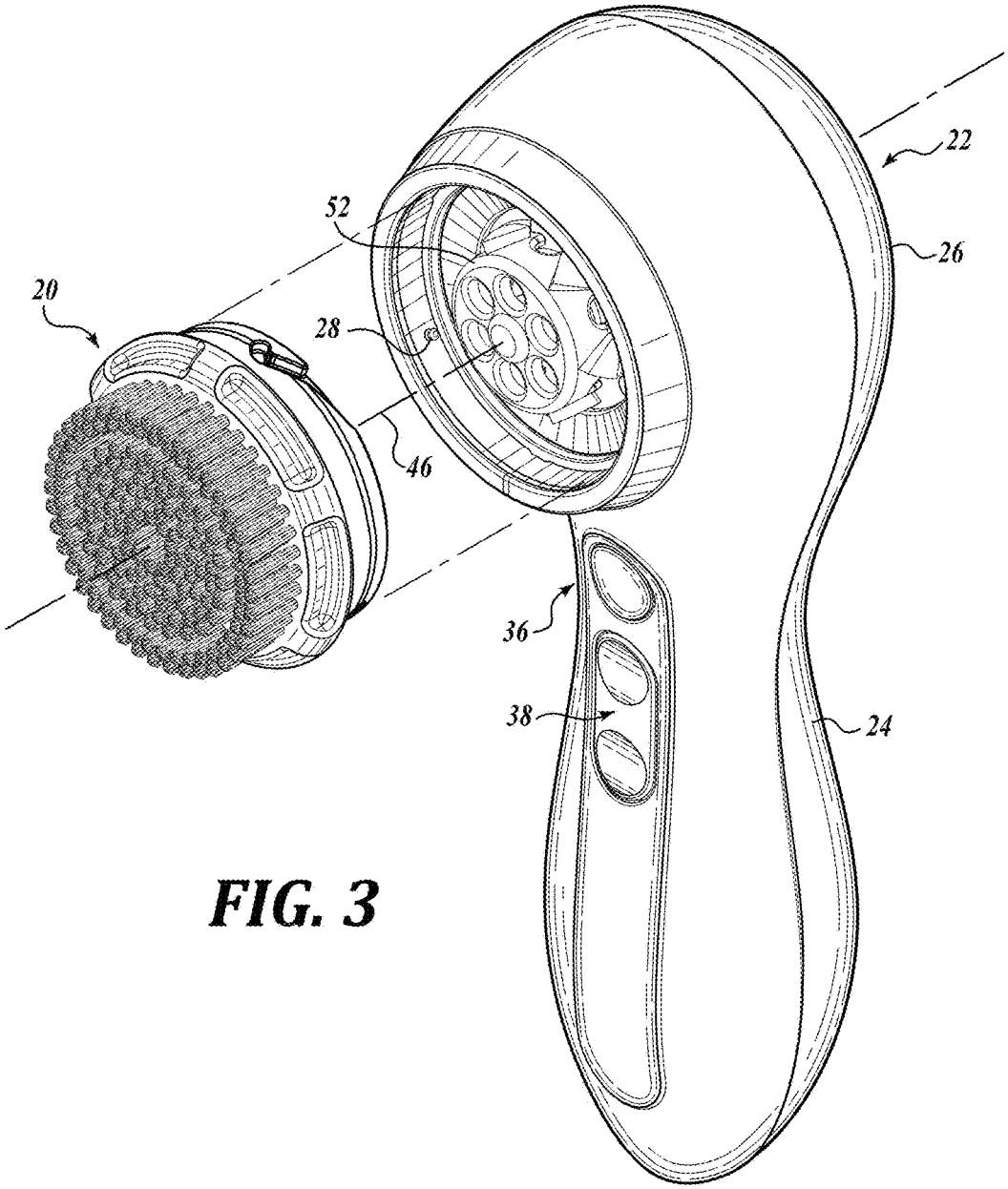
FIG. 3 is a perspective view of one example of a personal care appliance in accordance with embodiments disclosed herein.

Turning now to FIG. 3, there is shown one example of an appliance 22 in accordance with the disclosed embodiments having a brush workpiece. The appliance 22 includes a body 24 having a handle portion 26 and a workpiece attachment portion 28. The workpiece attachment portion 28 is configured to selective attach a workpiece 20 to the appliance 22. The appliance body 24 houses the operating structure of the appliance 22. An on/off button 36 is configured to selectively activate the appliance. In some embodiments, the appliance may also include power adjust or mode control buttons 38 coupled to control circuitry, such as a programmed microcontroller or processor, which is configured to control the frequency and amplitude of the oscillation of the workpiece 28. Brushes of the type illustrated in FIG. 3 are manufactured by Clarisonic (Redmond, Wash.). U.S. Pat. Nos. 7,786,626 and 7,157,816, both of which are hereby incorporated by reference in their entirety, are exemplary disclosures related to oscillating brushes useful in the disclosed embodiments.

End Effectors

In an embodiment, an end effector with a plurality of contact points is used for stimulating a portion of skin at a stimulation frequency where the contact points are located a target distance from each other that is based on an inverse of the stimulation frequency. In an embodiment, a system for stimulating a portion of skin at a stimulation frequency includes an appliance and an end effector with a plurality of contact points that are located a distance from each other that is based on an inverse of the stimulation frequency. In an embodiment, a method for stimulating a portion of skin at a stimulation frequency includes activating operation of a motor to impart movement to an end of an end effector and applying a force to bias the end effector toward the portion of skin to cause a cyclical stimulus of the portion of skin at about the stimulation frequency. Examples of cyclical stimuli include cyclical mechanical strain induced in the portion of skin, cyclical pressure waves induced into the portion of skin, and the like.

Figure 4A:
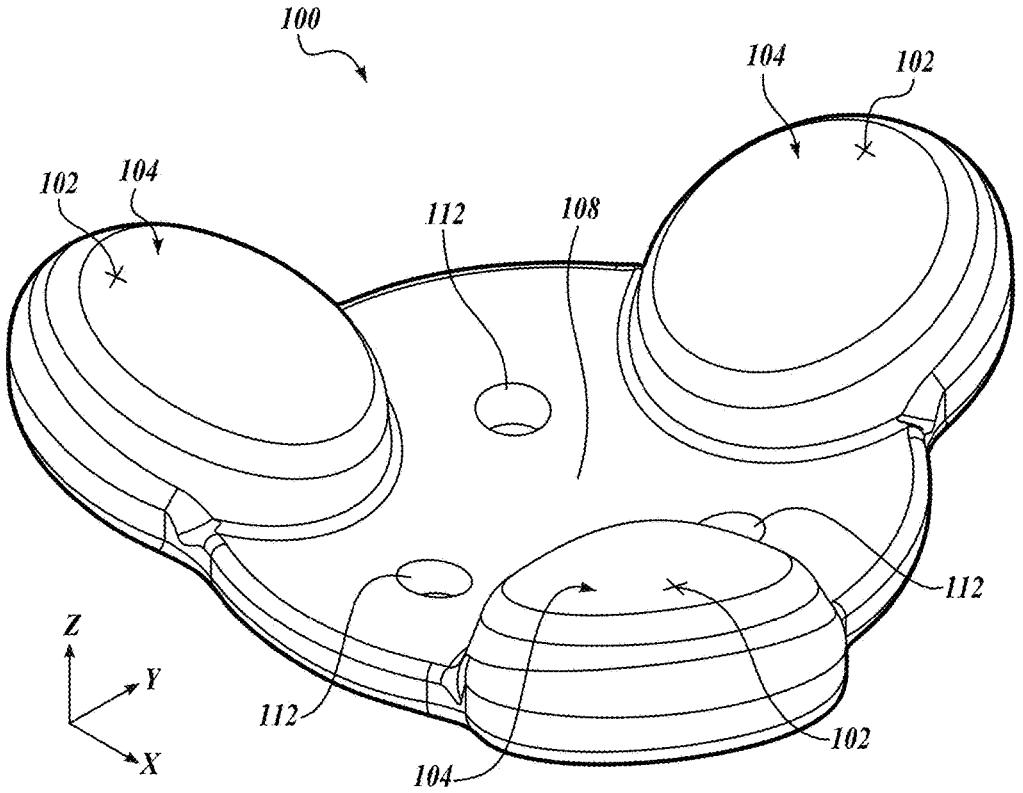
FIGS. 4A, 4B, and 4C depict, respectively, a perspective view, a side view, and a top view of an embodiment of an end effector in accordance with embodiments disclosed herein.
Figure 4B:
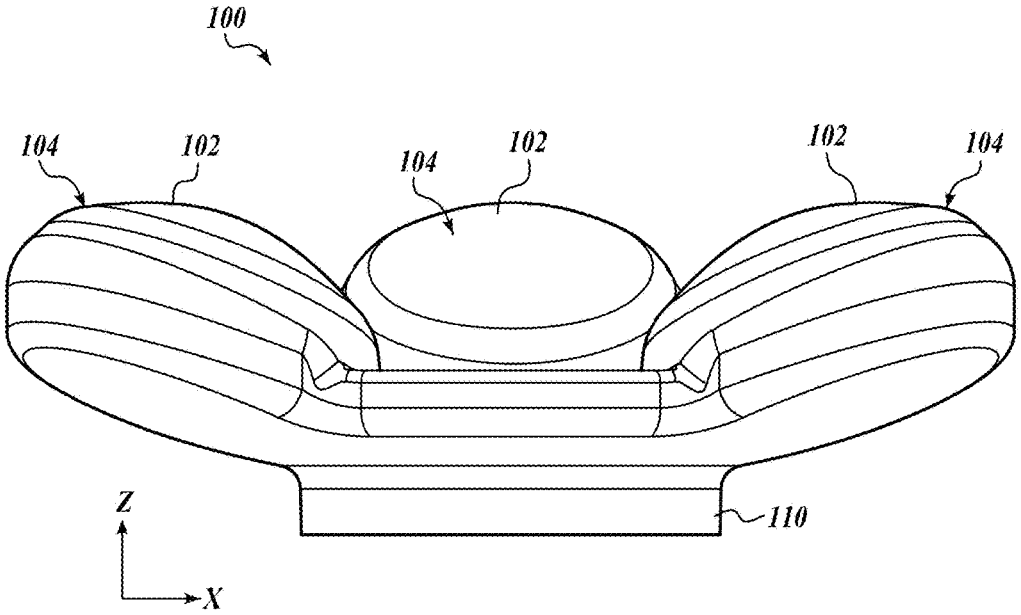
Figure 4C:
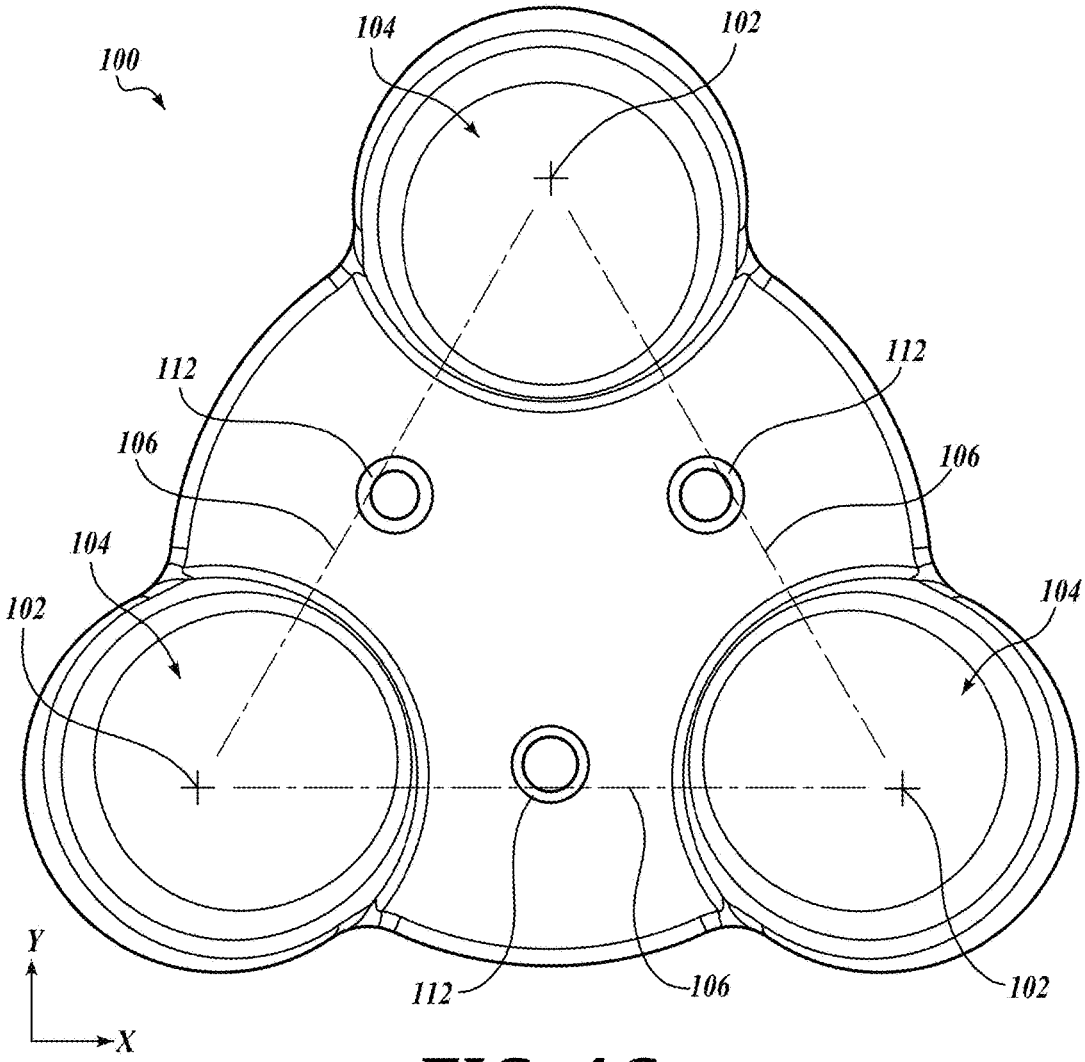

An embodiment of an end effector 100 is depicted in FIGS. 4A to 4C. The end effector 100 includes contact points 102. In an embodiment, contact points 102 can take a variety of shapes, configurations, and geometries including spheroidal, polygonal, cylindrical, conical, planar, parabolic, as well as regular or irregular forms.

The end effector 100 also includes contact areas 104. Each of the contact points 102 is located on one of the contact areas 104. In an embodiment, the contact points 102 are located a target distance 106 away from each other. For example, in an embodiment, the contact points 102 are located a target distance 106 away from each other determined from the inverse of the stimulation frequency. In the particular embodiment shown in FIGS. 4A to 4C, the contact points 102 include the contact points that are equidistant from each other (i.e., the distances 106 between contact points 102 are all about the same, such as being within ±5% of each other). The end effector 100 includes a central portion 108 located between the contact areas 104. FIGS. 4A to 4C depict a coordinate system with X-, Y-, and Z-directions. In the Z-direction, the central portion 108 is depressed from the contact areas 104 such that the contact points 102 of the contact areas 104 are the points at which the contact areas 104 would contact a flat object lowered in the Z-direction.

The end effector 100 includes a central support 110 on the opposite side of the central portion 108. As is seen in FIG. 4B, the contact areas 104 are located on portions of end effector 100 that are cantilevered out from the central support 110. In one embodiment, the end effector 100 is made of a non-rigid material. Some examples of non-rigid materials include plastics (e.g., polyurethane), elastomeric materials (e.g. thermoplastic elastomers), rubber materials, and any combinations thereof. In one example, the non-rigid material of the end effector 100 has a hardness in a rage from about 10 Shore A to about 60 Shore A, as defined by the American Society for Testing and Materials (ASTM) standard D2240. When the end effector 100 is made of a non-rigid material and the contact areas 104 are located on portions of end effector 100 that are cantilevered out from the central support 110, the portions of end effector 100 with the contact areas 104 have a spring-like quality that permits some movement of the contact areas 104 in the Z-direction.

In the embodiment shown in FIGS. 4A and 4C, the end effector 100 includes fastener holes 112. In one embodiment mechanical fasteners (e.g., screws, bolts, rivets, etc.) are placed in the fastener holes 112 to mechanically fasten the end effector 100 to another component. In one embodiment, the end effector 100 is couplable to a motor that is configured to move the end effector. In one example, when the end effector 100 is couplable to a motor and the motor is operating, the motor oscillates the end effector 100 with rotational movements about an axis in the Z-direction.

In one embodiment, the end effector 100 is used to stimulate a portion of skin at a stimulation frequency. In one embodiment, the end effector 100 is used to induce a cyclical response within a portion of skin at a target frequency. In one embodiment, the end effector 100 is used to apply a cyclical mechanical strain a portion of skin responsive to an applied potential. In an embodiment, the appliance 302 is configured to manage a duty cycle associated with driving an end effector. For example in an embodiment, the appliance 302 includes circuitry configured to manage a duty cycle associated with driving an end effector.

In one example, the stimulation frequency is selected based on a condition of the portion of skin. For example, the stimulation frequency is selected based on an anti-aging effect that is activated by cyclical mechanical strain of the portion of skin at the stimulation frequency. The contact points 102 are located at a target distance from each other based on an inverse of the stimulation frequency. For example, with a stimulation frequency of 60 Hz, the inverse of the stimulation frequency (i.e., the period) is 0.0167 seconds per cycle. With a propagation speed of 2.0 meters per second, the wavelength is 0.0333 meters per second, or 3.33 cm per second. Other examples of wavelength distances based on frequency are shown in TABLE 1.

TABLE 1

Example wavelength distances based on frequency

| Frequency (f) Hz (cycle/sec) | Period (T) (sec/cycle) | Speed[1] (v) (m/s) | Wavelength (λ) (m/cycle) | Wavelength (λ) (cm/cycle) |
|---|---|---|---|---|
| 60 | 0.0167 | 2.0 | 0.0333 | 3.33 |
| 65 | 0.0154 | 2.0 | 0.0308 | 3.08 |
| 70 | 0.0143 | 2.0 | 0.0286 | 2.86 |
| 75 | 0.0133 | 2.0 | 0.0267 | 2.67 |
| 80 | 0.0125 | 2.0 | 0.0250 | 2.50 |
| 85 | 0.0118 | 2.0 | 0.0235 | 2.35 |
| 90 | 0.0111 | 2.0 | 0.0222 | 2.22 |
| 95 | 0.0105 | 2.0 | 0.0211 | 2.11 |
| 100 | 0.0100 | 2.0 | 0.0200 | 2.00 |
| 105 | 0.0095 | 2.0 | 0.0190 | 1.90 |
| 110 | 0.0091 | 2.0 | 0.0182 | 1.82 |
| 115 | 0.0087 | 2.0 | 0.0174 | 1.74 |
| 120 | 0.0083 | 2.0 | 0.0167 | 1.67 |

[1]The speed of sound in skin is approximately 2.0 m/s.

In one embodiment, the contact points 102 are located at a distance from each other that is a whole integer increment of the inverse of the stimulation frequency. Using the 60 Hz example above, one whole integer increment of the inverse of the stimulation frequency is 6.66 cm. Thus, in this 60 Hz example, the distances 106 between the contact points 102 are 6.66 cm. Using another example with a 110 Hz stimulation frequency, the wavelength is 1.82 cm per cycle. One whole integer increment of the inverse of the stimulation frequency is 3.64 cm. Thus, in this 110 Hz example, the distances 106 between the contact points 102 are 3.64 cm. Many other examples of frequencies and whole increments of the inverse of the frequencies are possible.

Figure 5A:
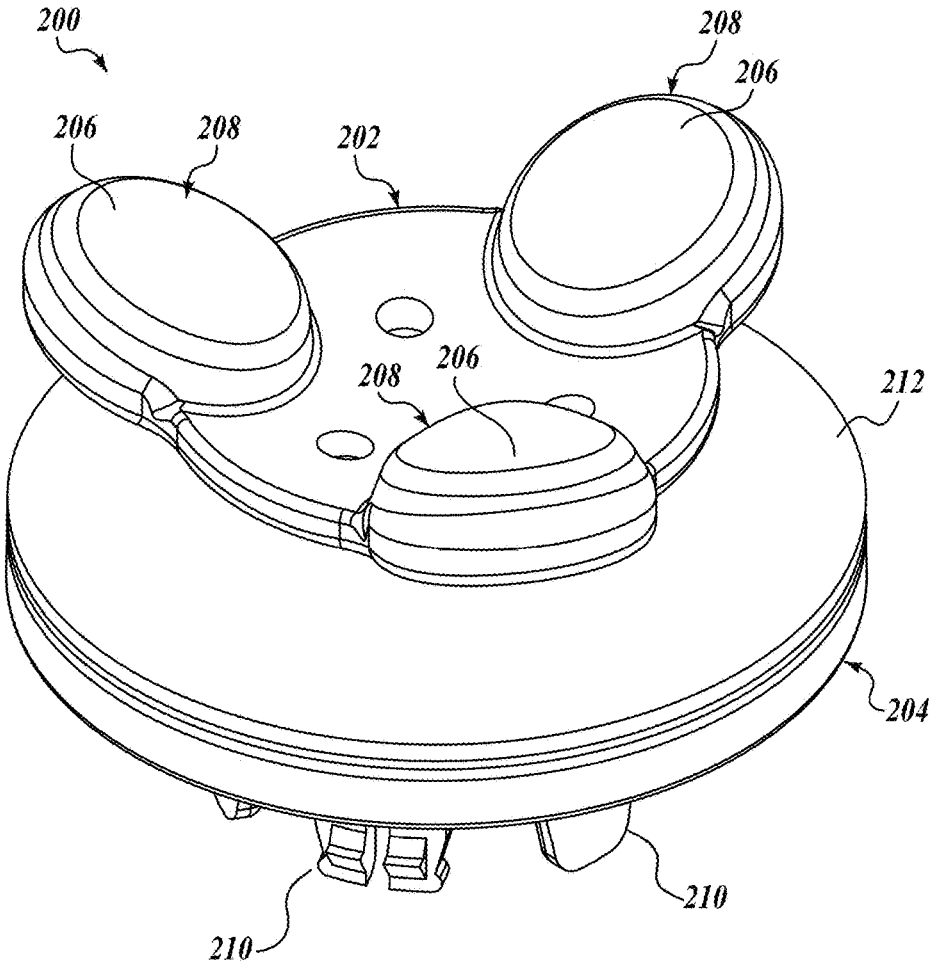
FIGS. 5A and 5B depict perspective views of another embodiment of an end effector in accordance with embodiments disclosed herein that includes an end portion and a base portion.
Figure 5B:
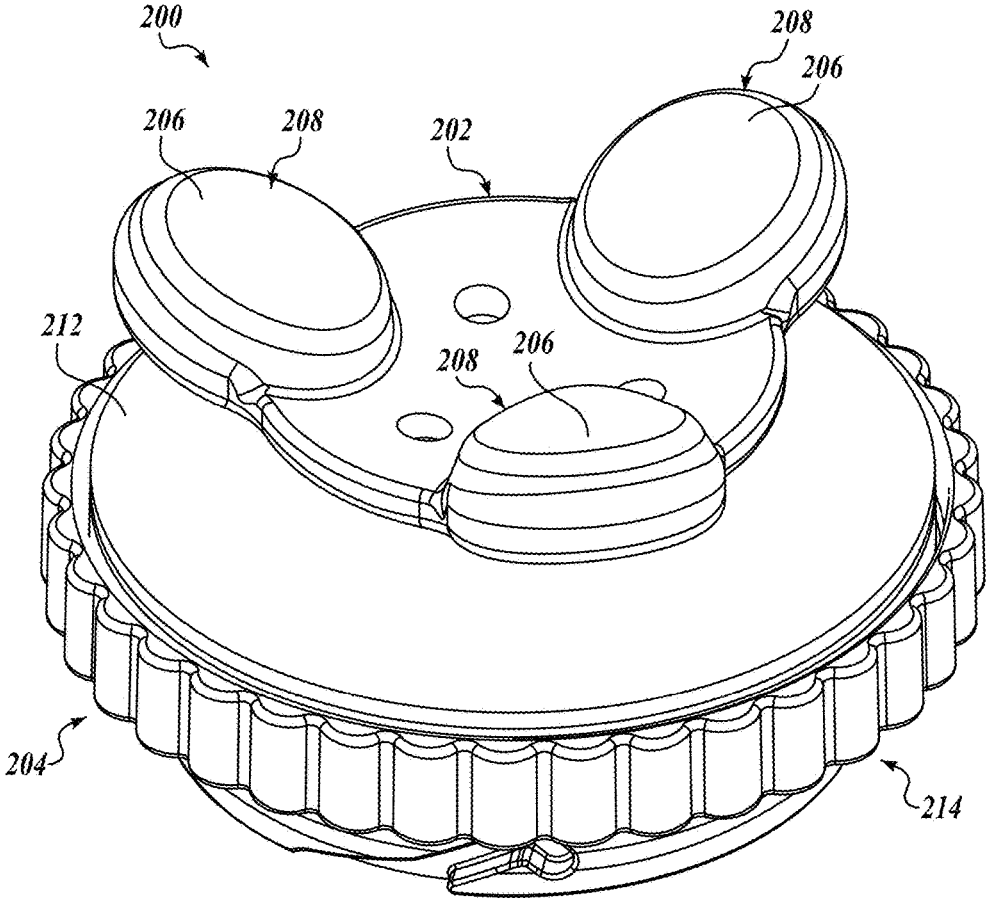

Another embodiment of an end effector 200 is depicted in FIGS. 5A and 5B. The end effector 200 includes an end portion 202 and a base portion 204. The end portion 202 includes contact points 206 and contact areas 208. Each of the contact points 206 is located on one of the contact areas 208. The base portion 204 includes a drive assembly 210 that is configured to engage a drive hub of an appliance (not shown). In one example, the appliance includes a motor that is operatively coupled to the drive hub. When the end effector 200 is releasably coupled to the appliance and the drive assembly 210 is engaged to the drive hub, operation of the motor causes movement of the drive hub that is transferred to the drive assembly to move the end effector.

As depicted in FIG. 5A, the end portion 202 of the end effector 200 is connected to the base portion 204 of the end effector 200 via a central support 212. The contact areas 206 are located on portions of the end portion 202 that are cantilevered out from the central support 212. In one embodiment, the end portion 202 is made of a non-rigid material and the contact areas 208 and the portions of the end portion 202 with the contact areas 208 have a spring-like quality that permits some movement of the contact areas 208. In one example, some or all of the base portion 204 is made of a rigid material. In this example, the portions of the end portion 202 with the contact areas 208 retain their spring-like quality even though some or all of the base portion 204 is made of a non-rigid material.

When the end effector 200 is coupled to a motor and the motor is operating, the system of the end effector 200 and the motor has a resonance frequency. The resonance frequency of the system is a function of characteristics of the system, such as operational parameters of the motor, mass of the motor, and mass of the end effector 200. In one embodiment, the end effector 200 is designed to be driven by a specific motor to stimulate a portion of skin at a stimulation frequency. In one example, the mass of the end effector 200 is selected such that the system of the end effector 200 and the specific motor has a resonance frequency based on the stimulation frequency. Selecting the mass of the end effector 200, in one example, includes selecting a mass of one or more of the end portion 202 or the base portion 204. In one example of a resonance frequency based on the stimulation frequency, the resonance frequency is approximately the same as the stimulation frequency. In other examples of resonance frequency based on the stimulation frequency, the resonance frequency is a whole integer increment of the stimulation frequency.

FIG. 5B depicts the end effector 200 that also includes a coupling ring 214. The coupling ring 214 is configured to couple the end effector 200 to another object, such as an appliance that includes a motor. Examples of end effectors coupled to appliances that include motors are described in greater detail below.

Figure 6:
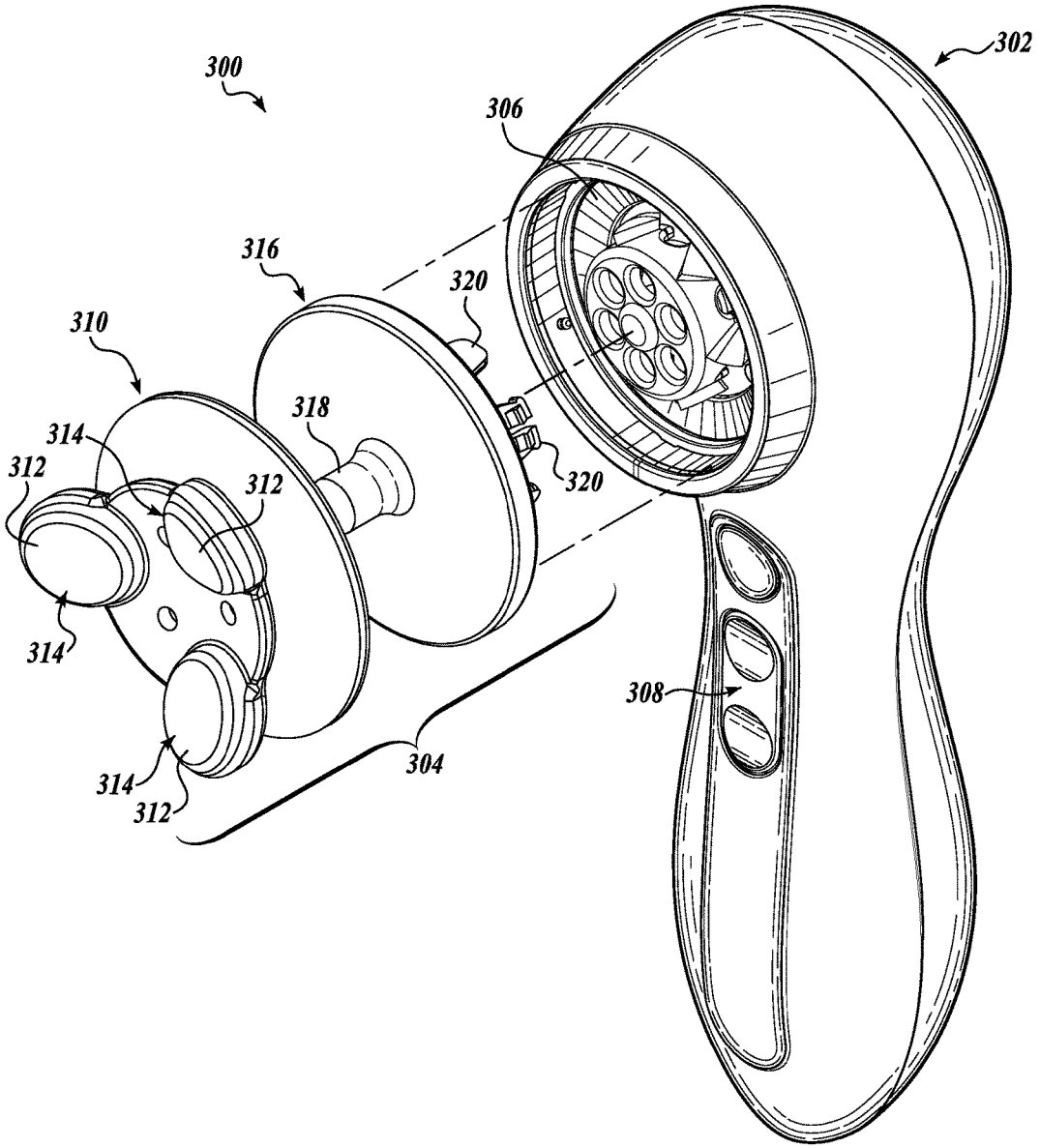
FIG. 6 depicts an embodiment of a system that includes an appliance and an end effector, in accordance with embodiments of end effectors described herein.

Embodiments of end effectors described herein are usable in a system, such as the system 300 depicted in FIG. 6. The system 300 includes an appliance 302 and an end effector 304. The appliance 302 depicted in FIG. 6 is in the form of a handle; however, the appliance 302 can take any number of other forms. The appliance 302 includes a drive hub 306. The appliance 302 includes a motor (not shown) that is operatively coupled to the drive hub 306 such that operation of the motor causes movement of the drive hub 306. The appliance 302 includes one or more user input mechanisms 308. In one embodiment, operation of the motor is based on user inputs received by the one or more user input mechanisms 308. In some examples, user input received by the one or more user input mechanisms 308 cause one or more of, initiating operation of the motor, changing an operating characteristic of the motor, and ceasing operation of the motor.

In an embodiment, the end effector 304 depicted in FIG. 6 includes an end portion 310 and a base portion 316. The end portion includes a plurality of contact points 312. In one embodiment, the plurality of contact points 312 are located a distance from each other based on an inverse of a stimulation frequency. Each of the plurality of contact points 312 is located on one of a plurality of contact areas 314. The base portion 316 is coupled to the end portion 310 via a central support 318. The base portion includes a drive assembly 320 that is configured to engage the drive hub 306 of the appliance 302.

In an embodiment, the end effector 304 is physically coupleable to the appliance 302. When the end effector 304 is coupled to the appliance 302, the drive assembly 320 of the end effector 304 is engaged to the drive hub 306 of the appliance 302 such that operation of the motor of the appliance 302 causes movement of the drive hub 306 that is transferred to the drive assembly 320 of the end effector 304 to move the end effector. In one embodiment, operation of the motor imparts oscillating movement to the end effector 304 with an amount of inertia to move the end effector 304 at a target frequency and amplitude. In one example, the motor is configured to drive the end effector 304 at a frequency in a range from about 60 Hz to about 120 Hz. In another example, the motor is configured to drive the end effector 304 at an angular amplitude in a range from about 2° to about 7° of peak-to-peak motion. Such oscillating movement of the end effector 304, when applied to a portion of skin, produces a cyclical stimulus within the portion of skin at about the stimulation frequency. In some examples, the oscillating frequency is about the stimulation frequency. In other examples, the oscillating frequency is different from the stimulation frequency. In one example, the cyclical stimulus is a cyclical mechanical strain at the stimulation frequency which stimulates certain anti-aging effects of a target biomarker.

In an embodiment, the end effector 304 is communicatively coupled to the appliance 302 via one or more communication interfaces.

Figure 7:
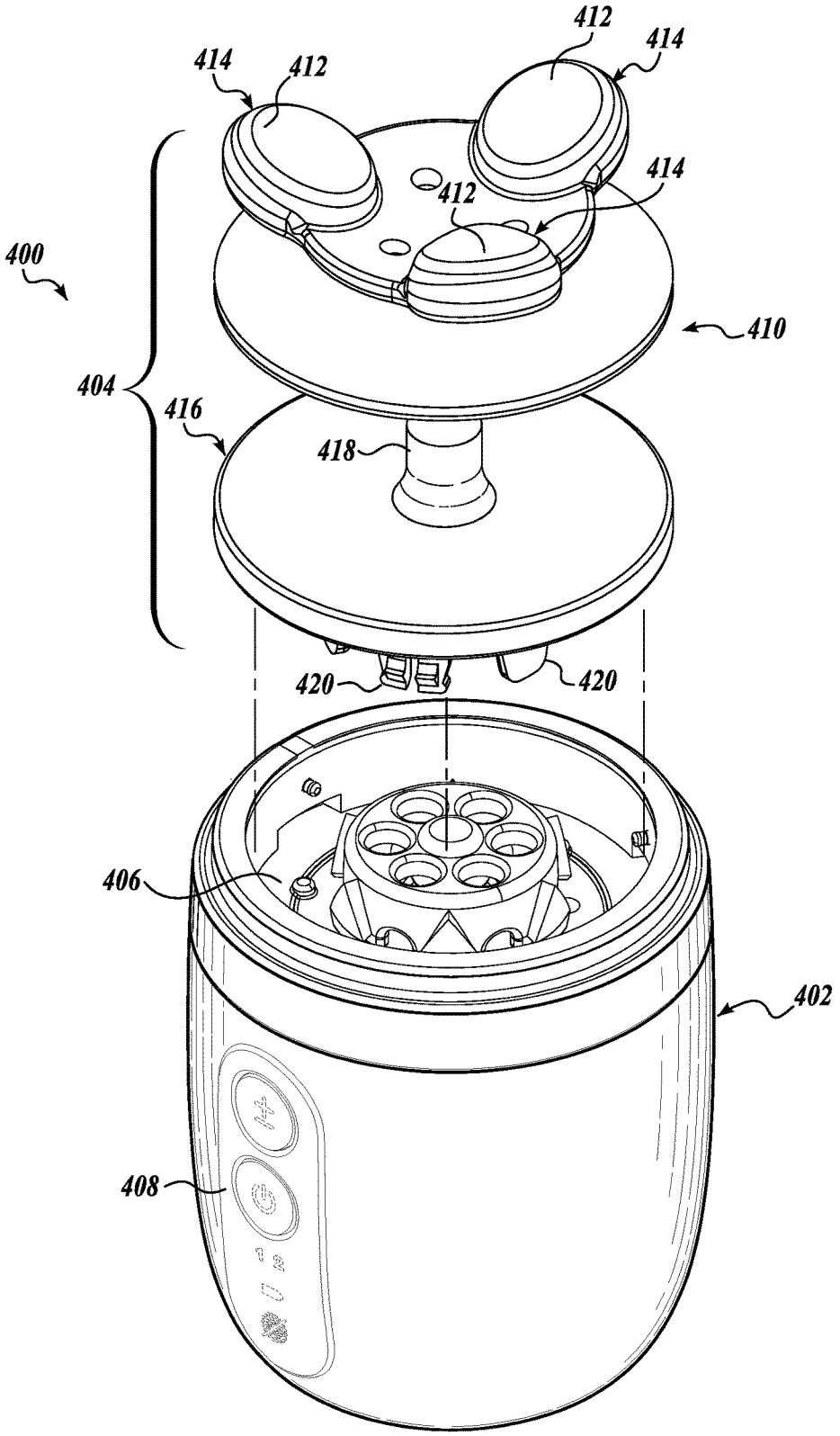
FIG. 7 depicts another embodiment of a system that includes an appliance and an end effector, in accordance with embodiments of end effectors described herein.

Another example of a system 400 with an appliance 402 and an end effector 404 is depicted in FIG. 7. The appliance 402 depicted in FIG. 7 is in the form of a hand-held appliance that is intended to be held against the palm of a user's hand with the user's fingers grasped around the appliance 402. While the appliance 402 is in the form of a hand-held appliance, the appliance 402 can take any number of other forms. The appliance 402 includes a drive hub 406. The appliance 402 includes a motor (not shown) that is operatively coupled to the drive hub 406 such that operation of the motor causes movement of the drive hub 406. The appliance 402 includes one or more user input mechanisms 408. In one embodiment, operation of the motor is based on user inputs received by the one or more user input mechanisms 408. In some examples, user input received by the one or more user input mechanisms 408 cause one or more of, initiating operation of the motor, changing an operating characteristic of the motor, and ceasing operation of the motor.

The end effector 404 depicted in FIG. 7 includes an end portion 410 and a base portion 416. The end portion includes a plurality of contact points 412. In one embodiment, the plurality of contact points 412 are located a distance from each other based on an inverse of a stimulation frequency. Each of the plurality of contact points 412 is located on one of a plurality of contact areas 414. The base portion 416 is coupled to the end portion 410 via a central support 418. The base portion includes a drive assembly 420 that is configured to engage the drive hub 406 of the appliance 402.

In one embodiment, the end effector 404 is usable interchangeably with both appliance 302 and appliance 402. In other words, in this particular example, the drive assembly 420 of end effector 404 is separately engagable with both the drive hub 306 of appliance 302 and the drive hub 406 of appliance 402. In one embodiment, the appliance 302 and the appliance 402 have different characteristics, such as different motor sizes, different motor inertias, etc. In such a case, the system with the end effector 404 and the appliance 302 has a different resonant frequency than the system with the end effector 404 and the appliance 402. Because of the difference in resonance frequencies with different combinations of end effectors and appliances, in some embodiments, end effectors are designed (such as by selecting a particular mass of the end effectors) to operate with specific appliances and/or motors to have a target resonance frequency.

In one embodiment, the end effector 404 is operably coupleable to the appliance 402. For example, when the end effector 404 is coupled to the appliance 402, the drive assembly 420 of the end effector 404 is engaged to the drive hub 406 of the appliance 402 such that operation of the motor of the appliance 402 causes movement of the drive hub 406 that is transferred to the drive assembly 420 of the end effector 404 to move the end effector. In one embodiment, operation of the motor imparts oscillating movement to the end effector 304 with an amount of inertia to move the end effector 404 at a target frequency and amplitude. In one example, the motor is configured to drive the end effector 404 at a frequency in a range from about 60 Hz to about 120 Hz. In another example, the motor is configured to drive the end effector 404 at an angular amplitude in a range from about 2° to about 7° of peak-to-peak motion. Such oscillating movement of the end effector 404, when applied to a portion of skin, produces a cyclical stimulus within the portion of skin at about the stimulation frequency. In some examples, the oscillating frequency is about the stimulation frequency. In other examples, the oscillating frequency is different from the stimulation frequency. In one example, the cyclical stimulus is a cyclical mechanical strain at the stimulation frequency, which stimulates certain anti-aging effects of a target biomarker.

Figure 8:
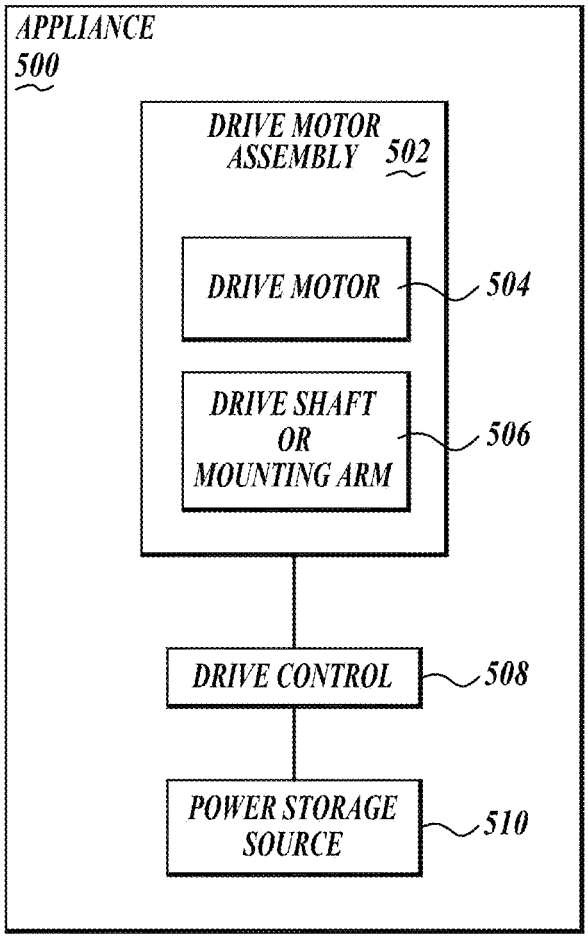
FIG. 8 depicts, in block diagrammatic form, an example of operating structure of an appliance, in accordance with embodiments of appliances described herein.

FIG. 8 depicts, in block diagrammatic form, an example of operating structure of an appliance 500. The other embodiments of appliances described herein, such as appliance 302 and appliance 402, include, in some example, operating structure such as the operating structure shown in FIG. 8. In one embodiment, appliance 500 includes a drive motor assembly 502, a power storage source 510, such as a rechargeable battery, and a drive control 508. In one example, the drive control 508 is coupled to or includes one or more user interface mechanisms (e.g., the one or more user interface mechanisms 308 in FIG. 6 and the one or more user interface mechanisms 408 in FIG. 7). The drive control 570 is configured and arranged to selectively deliver power from the power storage source 510 to the drive motor assembly 502. In an embodiment, the drive control 508 includes a power adjust or mode control buttons coupled to control circuitry, such as a programmed microcontroller or processor, which is configured to control the delivery of power to the drive motor assembly 502. The drive motor assembly 502 in an embodiment includes an electric drive motor 504 (or simply motor 504) that drives an attached head, such as an end effector, via a drive gear assembly.

In one embodiment, when an end effector is coupled to the appliance 500 (e.g., such as when end effector 304 is coupled to appliance 302 in FIG. 6), the drive motor assembly 502 is configured to impart oscillatory motion to the end effector in a first rotational direction and a second rotational direction. In one embodiment, the drive motor assembly 502 includes a drive shaft 506 (also referred to as a mounting arm) that is configured to transfer oscillatory motion to a drive hub of the appliance 500. The appliance 500 is configured to oscillate the end effector at sonic frequencies. In an embodiment, the appliance 500 oscillates the end effector at frequencies from about 60 Hz to about 120 Hz. One example of a drive motor assembly 502 that may be employed by the appliance 500 to oscillate the end effector is shown and described in U.S. Pat. No. 7,786,646. However, it should be understood that this is merely an example of the structure and operation of one such appliance and that the structure, operation frequency and oscillation amplitude of such an appliance could be varied, depending in part on its intended application and/or characteristics of the applicator head, such as its inertial properties, etc. In an embodiment of the present disclosure, the frequency ranges are selected so as to drive the end effector at near resonance. Thus, selected frequency ranges are dependent, in part, on the inertial properties of the attached head. It will be appreciated that driving the attached head at near resonance provides many benefits, including the ability to drive the attached head at suitable amplitudes in loaded conditions (e.g., when contacting the skin) For a more detailed discussion on the design parameters of the appliance, please see U.S. Pat. No. 7,786,646.

Figure 9A:
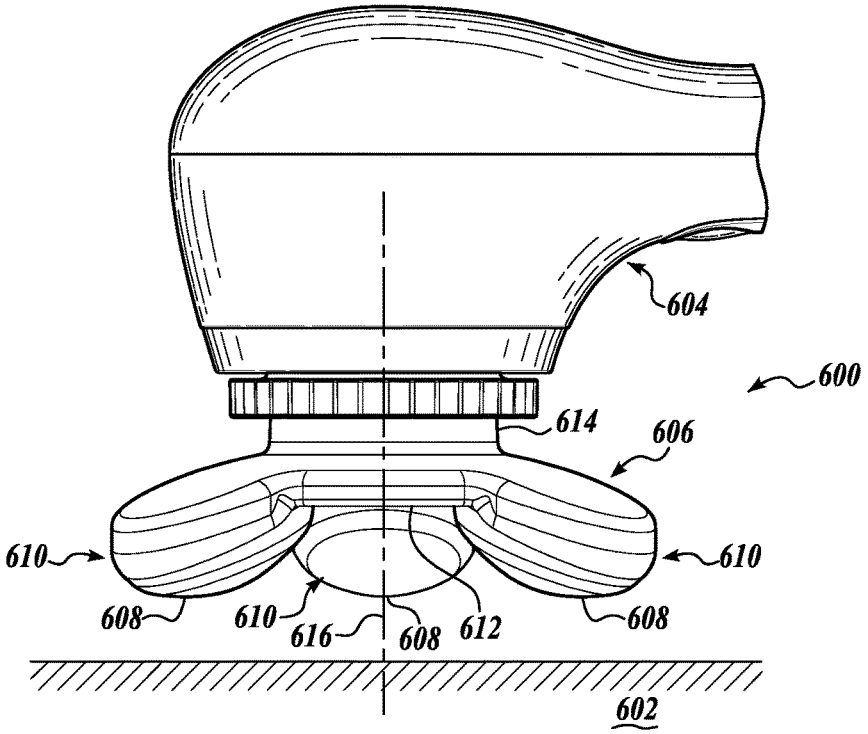
FIGS. 9A and 9B depict, respectively, an unloaded condition and a loaded condition of an embodiment of a system with an appliance and an end effector against a portion of skin.
Figure 9B:
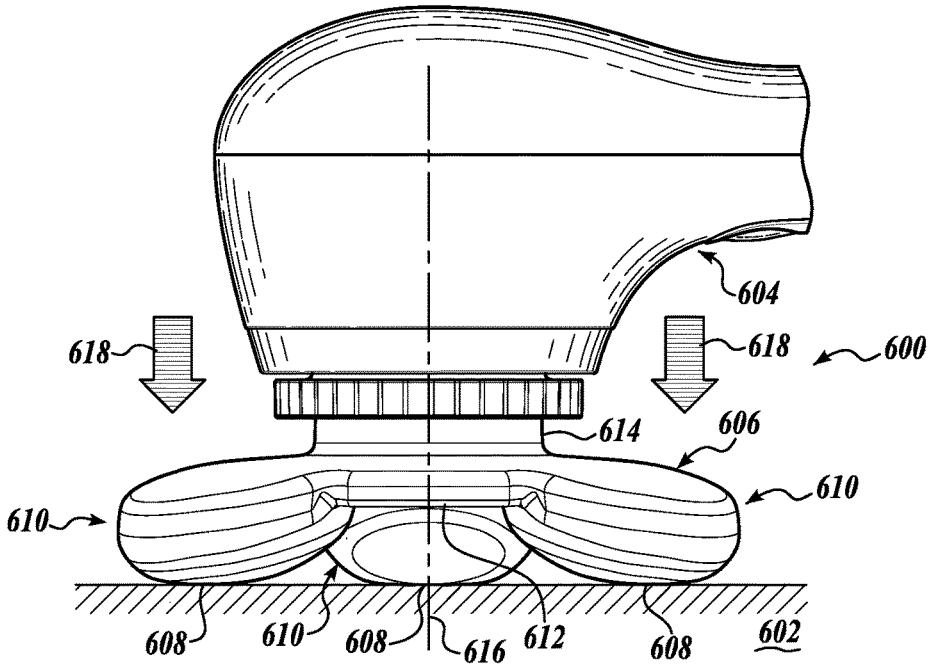

FIGS. 9A and 9B depict, respectively, an unloaded condition and a loaded condition of a system 600 against a portion of skin 602. The system includes an appliance 604 coupled to an end effector 606. The end effector 606 includes a plurality of contact points 608. In one embodiment, the plurality of contact points 608 are located a distance from each other based on an inverse of a stimulation frequency. Each of the plurality of contact points 608 is located on one of a plurality of contact areas 610. The end effector has a central portion 612 located between the plurality of contact areas 610. The end effector 606 is coupled to appliance 604 via a central support 614 that is located opposite of the central portion 612. The portions of the end effector 606 that includes the contact areas 610 are cantilevered out away from the central support 614.

In the embodiment shown in FIG. 9A, the system 600 is in an unloaded state (i.e., the end effector 606 is not in contact with the portion of skin). The appliance includes a motor that moves the end effector 606. In one embodiment, the motor imparts oscillating movements to the end effector 606 about an axis 616. When the motor is operating, the system 600 has a resonant frequency based on a desired stimulation frequency. In one embodiment, the stimulation frequency is selected based on an anti-aging effect stimulated by a cyclical stimulus within the portion of skin at the stimulation frequency. As shown in FIG. 9A, the end effector 606 has a cupped shape where the contact points 608 are located closer to the portion of skin 602 than the central portion 612. From the point shown in FIG. 9A, as the system 600 is lowered to the portion of skin 602, the contact points 608 are the first portions of the system 600 to contact the portion of skin 602.

In the embodiment shown in FIG. 9B, a force 618 is applied to the system 600 to bias the end effector 606 toward the portion of skin 602. In one embodiment, the force 618 applied to the system 600 is in a range from about 85 grams-force (approximately 0.83 N) to about 100 grams-force (approximately 0.98 N). In the embodiment shown in FIG. 9B, the force 618 applied to the system 600 causes the cantilevered portions of the end effector 606 to deflect toward the appliance 604. Such a deflection of the cantilevered portions is possible, in some examples, because the cantilevered portions of the end effector 606 are made of a non-rigid material. While the deflection of the cantilevered portions of the end effector 606 may modify the cup shape of the end effector 606, the force 618 does not cause the central portion 612 to touch the portion of skin 602. Thus, only the contact areas 610 remain in contact with the portion of skin 602 when the force 618 is applied. Any contact of the end effector 606 with the portion of skin 602, other than the contact between the contact areas 610 and the end effector 606, may disrupt any cyclical stimulus of the portion of skin 602 by the end effector 606.

With the force 618 applied to the system 600, the operating motor of the appliance 604 continues to move the end effector 606. The movement of the end effector 606 when the force 618 is applied to the system 600 produces a cyclical stimulus within the portion of skin 602 at about the stimulation frequency. In one example, the cyclical stimulus is a wave-based mechanical strain that propagates through the portion of skin 602. The location of the plurality of contact points 608 (i.e., at a distance from each other based on an inverse of a stimulation frequency), encourages propagation of the cyclical stimulus because the cyclical stimulus created by each of the plurality of contact points 608 is in phase with the other(s) of the plurality of contact points 608. In other words, one of the plurality of contact points 608 does not cancel out the cyclical stimulus created by another one of the plurality of contact points 608.

Control Circuitry

Any of the disclosed methods can be implemented using circuitry in order to control an appliance or other embodiment for performing the disclosed methods.

In one aspect, an anti-aging circuit is provided that is configured to generate one or more control commands for controlling and powering the cyclical mechanical strain component. In one embodiment, the anti-aging circuit is operably couplable to an appliance configured to cause induction of mechanical strain within a portion of skin sufficient to modulate one or more cutaneous proteins.

In one embodiment, the anti-aging circuit is configured to vary a duty cycle associated with causing the induction of mechanical strain within a portion of skin sufficient to modulate one or more cutaneous proteins.

In one embodiment, the anti-aging circuit is configured to generate one or more control commands for controlling and powering the cyclical mechanical strain component In one embodiment, the anti-aging circuit is configured to instruct the cyclical mechanical strain component to cause induction of mechanical strain within the portion of skin sufficient to modulate one or more cutaneous proteins.

In one embodiment, the anti-aging circuit is configured to instruct the cyclical mechanical strain component to cause induction of mechanical strain having at least two different characteristics within the portion of skin sufficient to modulate one or more cutaneous proteins.

In one embodiment, the anti-aging circuit is configured to instruct the cyclical mechanical strain component to apply the mechanical strain to the portion of skin including the two or more treatment operations being applied in a in a manner selected from the group consisting of sequentially, concurrently, and combinations thereof. For example, in one embodiment, the circuitry is configured to provide instructions to an appliance to sequentially apply a first peak cyclic or oscillation frequency for a first treatment period and then apply a second peak cyclic or oscillation frequency for a second treatment period. Further treatment periods of different or similar character are included in further embodiments. Such a multi-part treatment allows a user to benefit from protein upregulation from two or more frequencies.

In an embodiment, the anti-aging circuit is configured to apply two or more frequencies concurrently.

In an embodiment, the anti-aging circuit is configured to apply a cyclical mechanical strain having a peak cyclic or oscillation frequency ranging from about 30 hertz to about 50 hertz for a duration sufficient to affect upregulation of one or more epidermis-associated proteins without substantially affecting upregulation of one or more dermoepidermal-junction-associated proteins or dermis-associated proteins in the portion of skin.

In an embodiment, the anti-aging circuit is configured to apply a cyclical mechanical strain having a peak cyclic or oscillation frequency ranging from about 50 hertz to about 100 hertz for a duration sufficient to affect upregulation of one or more epidermis-associated proteins, dermoepidermal-junction-associated proteins, or dermis-associated proteins in the portion of skin.

In an embodiment, the anti-aging circuit is configured to apply a cyclical mechanical strain having a peak cyclic or oscillation frequency ranging from about 100 hertz to about 140 hertz for a duration sufficient to affect upregulation of one or more epidermis-associated proteins or dermoepidermal-junction-associated proteins without substantially upregulating one or more dermis-associated proteins in the portion of skin.

Certain embodiments disclosed herein utilize circuitry in order to implement treatment protocols, operably couple to or more components, generate information, determine operation conditions, control an appliance or method, and the like. Circuitry of any type can be used. In an embodiment, circuitry includes, among other things, one or more computing devices such as a processor (e.g., a microprocessor), a central processing unit (CPU), a digital signal processor (DSP), an application-specific integrated circuit (ASIC), a field-programmable gate array (FPGA), or the like, or any combinations thereof, and can include discrete digital or analog circuit elements or electronics, or combinations thereof. In an embodiment, circuitry includes one or more ASICs having a plurality of predefined logic components. In an embodiment, circuitry includes one or more FPGA having a plurality of programmable logic components.

In an embodiment, the appliance includes circuitry having one or more components operably coupled (e.g., communicatively, electromagnetically, magnetically, ultrasonically, optically, inductively, electrically, capacitively coupled, or the like) to each other. In an embodiment, circuitry includes one or more remotely located components. In an embodiment, remotely located components are operably coupled via wireless communication. In an embodiment, remotely located components are operably coupled via one or more receivers, transmitters, transceivers, or the like.

In an embodiment, circuitry includes one or more memory devices that, for example, store instructions or data. Non-limiting examples of one or more memory devices include volatile memory (e.g., Random Access Memory (RAM), Dynamic Random Access Memory (DRAM), or the like), non-volatile memory (e.g., Read-Only Memory (ROM), Electrically Erasable Programmable Read-Only Memory (EEPROM), Compact Disc Read-Only Memory (CD-ROM), or the like), persistent memory, or the like. Further non-limiting examples of one or more memory devices include Erasable Programmable Read-Only Memory (EPROM), flash memory, or the like. The one or more memory devices can be coupled to, for example, one or more computing devices by one or more instructions, data, or power buses.

In an embodiment, circuitry includes one or more computer-readable media drives, interface sockets, Universal Serial Bus (USB) ports, memory card slots, or the like, and one or more input/output components such as, for example, a graphical user interface, a display, a keyboard, a keypad, a trackball, a joystick, a touch-screen, a mouse, a switch, a dial, or the like, and any other peripheral device. In an embodiment, circuitry includes one or more user input/output components that are operably coupled to at least one computing device to control (electrical, electromechanical, software-implemented, firmware-implemented, or other control, or combinations thereof) at least one parameter associated with the application of cyclical mechanical strain by the appliance, for example, controlling the duration and peak cyclic or oscillation frequency of the workpiece of the appliance.

In an embodiment, circuitry includes a computer-readable media drive or memory slot can be configured to accept signal-bearing medium (e.g., computer-readable memory media, computer-readable recording media, or the like). In an embodiment, a program for causing a system to execute any of the disclosed methods can be stored on, for example, a computer-readable recording medium (CRMM), a signal-bearing medium, or the like. Non-limiting examples of signal-bearing media include a recordable type medium such as a magnetic tape, floppy disk, a hard disk drive, a Compact Disc (CD), a Digital Video Disk (DVD), Blu-Ray Disc, a digital tape, a computer memory, or the like, as well as transmission type medium such as a digital and/or an analog communication medium (e.g., a fiber optic cable, a waveguide, a wired communications link, a wireless communication link (e.g., transmitter, receiver, transceiver, transmission logic, reception logic, etc.). Further non-limiting examples of signal-bearing media include, but are not limited to, DVD-ROM, DVD-RAM, DVD+RW, DVD-RW, DVD-R, DVD+R, CD-ROM, Super Audio CD, CD-R, CD+R, CD+RW, CD-RW, Video Compact Discs, Super Video Discs, flash memory, magnetic tape, magneto-optic disk, MINIDISC, non-volatile memory card, EEPROM, optical disk, optical storage, RAM, ROM, system memory, web server, or the like.

In an embodiment, the appliance includes circuitry having one or more modules optionally operable for communication with one or more input/output components that are configured to relay user output and/or input. In an embodiment, a module includes one or more instances of electrical, electromechanical, software-implemented, firmware-implemented, or other control devices. Such devices include one or more instances of memory; computing devices; antennas; power or other supplies; logic modules or other signaling modules; gauges or other such active or passive detection components; piezoelectric transducers, shape memory elements, micro-electro-mechanical system (MEMS) elements, or other actuators.

In an embodiment, circuitry includes hardware circuit implementations (e.g., implementations in analog circuitry, implementations in digital circuitry, and the like, and combinations thereof).

In an embodiment, circuitry includes combinations of circuits and computer program products having software or firmware instructions stored on one or more computer readable memories that work together to cause a device to perform one or more methodologies or technologies described herein.

In an embodiment, circuitry includes circuits, such as, for example, microprocessors or portions of microprocessor, that require software, firmware, and the like for operation.

In an embodiment, circuitry includes an implementation comprising one or more processors or portions thereof and accompanying software, firmware, hardware, and the like.

In an embodiment, circuitry includes a baseband integrated circuit or applications processor integrated circuit or a similar integrated circuit in a server, a cellular network device, other network device, or other computing device.

The following Examples are included for the purpose of illustrating the disclosed embodiments and are not meant to be limiting.

EXAMPLES

The following relates to an evaluation of the influence of peak oscillation frequency transmitted by an oscillatory brush on skin biology.

Experiments were conducted on human skin explants in survival. This study includes a comparison study performed with a Clarisonic Mia Brush (peak oscillation frequency of 176 Hz) to evaluate the effect of an existing brush on anti-aging markers.

To evaluate the effect of others frequencies, to optimize the anti-aging results, we develops a resonant appliance, the "Sonic Stimulator," for gently inducing mechanical strain in the skin at specific frequencies from 0 to 300 Hz.

Two experiments were conducted on human skin explants in survival with this resonant device with a "Delicate" Clarisonic brush head to test the effect of frequencies lower than 176 Hz.

Device treatment was applied on the skin surface at 40 Hz-60 Hz-90 Hz and 120 Hz, twice daily for one minute each treatment session over the course of 10 days.

Immunolabeling analysis on characteristic aging markers show specific effects for each frequency tested. Briefly summarizing the findings of these studies:

- The 40 Hz treatment induced an anti-aging surface effect: epidermal renewal (upregulation of CD44, HAS3 and Filaggrin).
- The 60 Hz treatment induced a global anti-aging effect on all skin layers: increasing of epidermal differentiation and cohesion (strong upregulation of CD44, filaggrin, K10, and Syndecan1, but also slight increase of K14 and TGK1), significant increasing of DEJ cohesion (Laminin5, Coll 7 and Perlecan, and a slight effect on Coll4), upregulation of ECM protein synthesis (Fibronectin, Procoll 1 and HAS3) and integrin β expression.
- The 90 Hz treatment induced a global anti-aging effect (but less intense compared with 60 Hz effects) on all skin layers: increasing of epidermal differentiation (Filaggrin) and renewal (CD44, Syndecan1), increasing of DEJ cohesion (Laminin 5 and Coll4) and increasing of ECM production (Tenascin, Fibronectin, Tropoelastin and HAS3).
- The 120 Hz treatment induces a global effect on epidermal renewal (CD44, Filaggrin and Syndecan) and collagen production in DEJ (strong upregulation of Coll 4 and Coll 7).
- For Comparison, a 176 Hz treatment (Clarisonic frequency) induces some effects at all skin levels with increase of epidermal differentiation and renewal (TGK1, CD44 and Syndecan 1), increase of DEJ cohesion (Laminin5, Coll 7) and increase of ECM production (Tenascin C, Procoll 1 and Tropoelastin), but as for the 120 Hz treatment, the effects seems to be less strong than the 60 Hz treatment.

I. INTRODUCTION

Anti-aging effects were studied using a device able to change frequency and amplitude of the vibration imposed. In an embodiment, a device was used to gently induce mechanical strain in the skin at specific frequencies from 0 to 300 Hz and from 0 to 12° of angular oscillating displacement.

At least two experiments were conducted on human skin explants in survival with a Sonic Stimulator with a "Delicate" brush head at different frequencies: 40 Hz-60 Hz-90 Hz and 120 Hz. Displacement were maintained constant at 8° in loaded mode (8° is the Mia brush displacement when the brush head is in contact with the skin.

The study was conducted twice to confirm the results on two donors.

Device treatment was applied on skin surface 2 times a day (1 minute) during 9 days in the first study and 11 days in the second study.

Figure 10A:
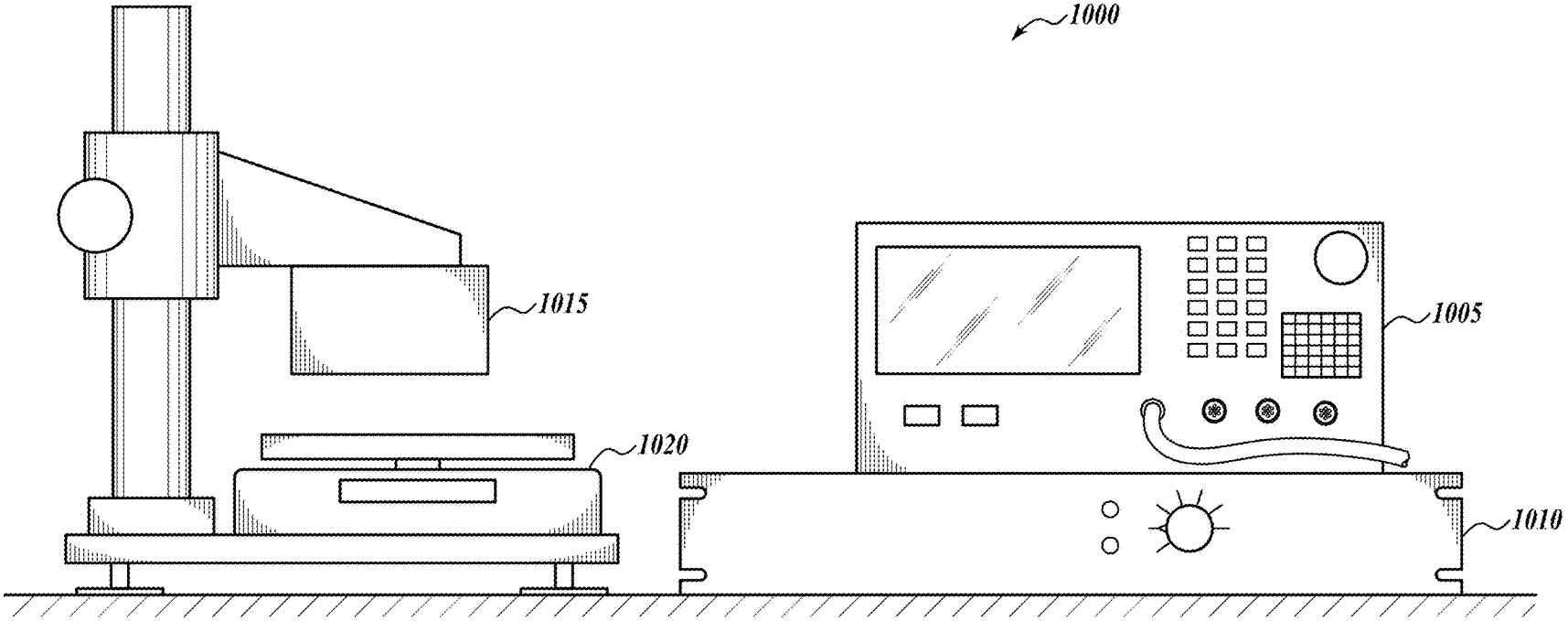
FIGS. 10A-10C illustrate experimental system used to test the disclosed embodiments.

The Sonic Stimulator System used for this testing is illustrated in FIG. 10A, induces sonic brush movement and can applied on ex vivo skin. This system 1000 is composed of a wave generator 10005, an amplifier 1010, a motor 1015 and a scale 1020 to measure pressure applied.

A Delicate Clarisonic Brush delivers vibrations into the skin from the motor 1015 with a pressure measured by the scale 1020.

II. MATERIAL AND METHODS

II.1 Human Skin Model

In both studies, 30 ex vivo skin explants of 2.5 cm×2.5 cm obtained after abdominal plastic surgery (donor woman aged 39 and 50 years) were used.

Non-woven MEFRA gauzes were placed in Petri dishes of 10 cm in diameter with 15 ml of maintenance medium. A skin explants were placed on gauze and the explants were then incubated at 37° C., 5% CO2.

Figure 10B:
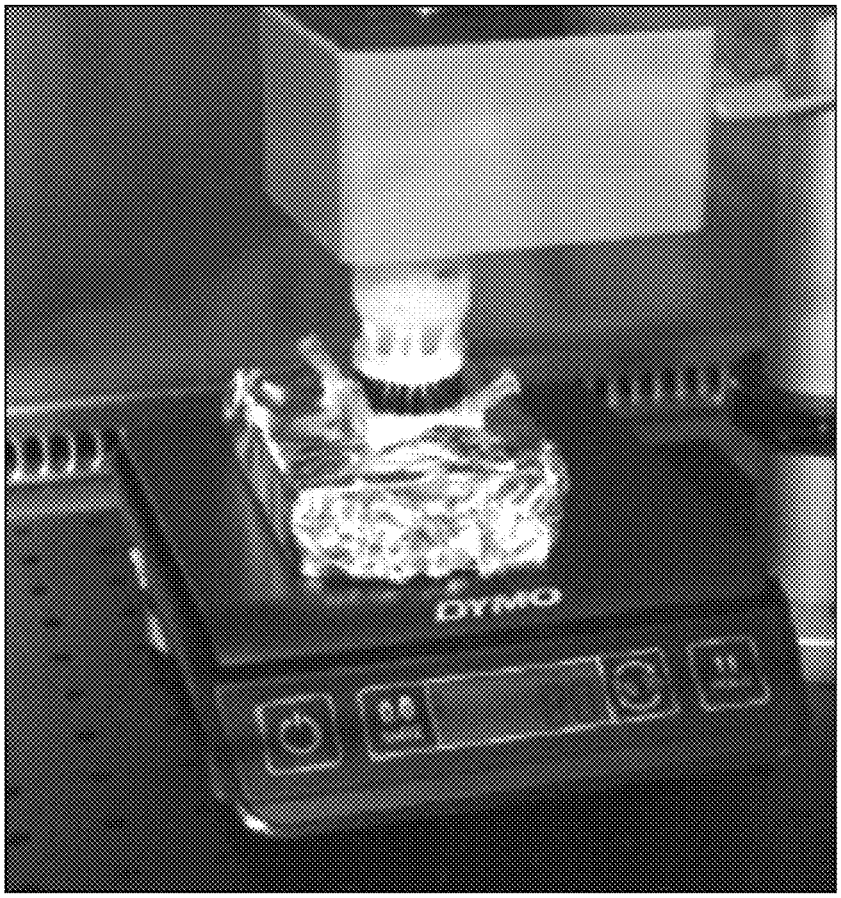

As illustrated in FIG. 10B, the brush was applied to the skin. The pressure applied by the brush was controlled for each sample and calibrated at 80 g with a scale.

Figure 10C:
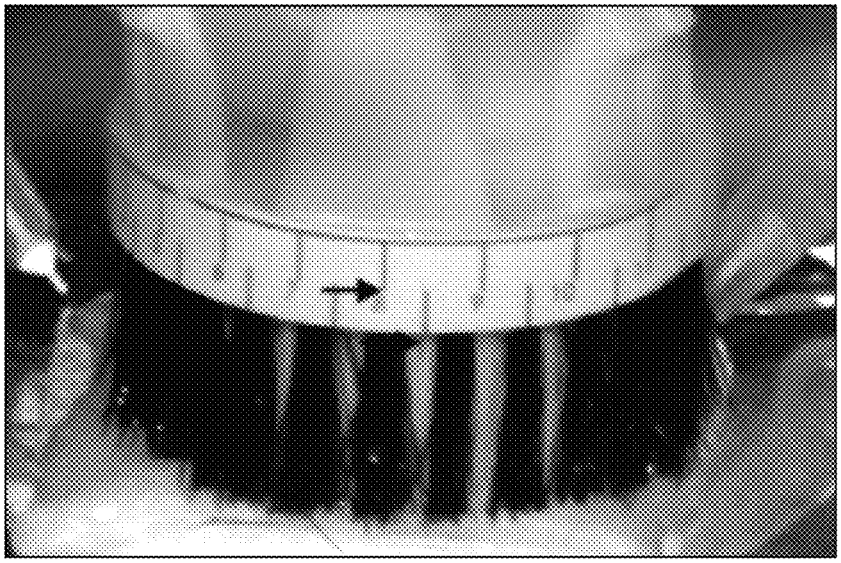

As illustrated in FIG. 10C, a grid on the edge of the brush allow us to calibrate the movement of the brush in loaded mode at 8°.

II.2 Brush Treatments

In both studies the skins were treated two times/day for one minute.

At each treatment the skins were raised from the gauze and put on a plane. The skins were placed in tension with needles before being brushed.

The skins were treated with the Sonic Stimulator and the "Delicate" head, and only the internal part of the brush head was used. The pressure applied by the brush were controlled for each simple and calibrated at 80 g with a scale.

A grid on the edge of the brush was used to determine the amplitude of the movement exerted on the explants and were calibrated at 8° in contact with the skin.

In both studies, half the cultures was analyzed 5 or 6 days after the beginning of the treatment (D5 and D6) and the other half, 9 or 11 days after the beginning of the treatment (D9 and D11).

II.3 Experimental Design:

5 different experimental conditions were tested:

control (Untreated skin)

40 Hz treatment during 1 minute 2 times a day

60 Hz treatment during 1 minute 2 times a day

90 Hz treatment during 1 minute 2 times a day

120 Hz treatment during 1 minute 2 times a day

The Mia brush was also used as a comparison, operating at 176 Hz.

At the end of each incubation time, half the cultures grown under each condition were stopped. Culture supernatants were collected and frozen at −80° C. until completion of ELISA assays. One punch of 8 mm diameter was made in each explant. Half of the punches were frozen in isopentane/liquid nitrogen and stored at −80° C. until the cutting of cryosections and the other half were fixed in formalin for embedding in paraffin.

II.4 Histological Analysis

Haematoxylin/Eosin/Safran staining (HES) of the all samples was performed.

II.5 Fluorescent Immunolabeling

Immunolabelling and analysis using an epifluorescence microscope was performed. The following markers were studied:

Epidermis: CD44, Filaggrin, K10, K14, TGK1, Syndecan1, ActinG/ActinF

DEJ: Laminin5, Coll4, Coll7, Perlecan,

Dermis: Tenascin C, Fibronectin, Procoll1, Tropoelastin, HAS3, Decorin, Integrinβ

Quantitative fluorescence analysis was performed with Histolab software.

A statistical analysis was also performed: the statistical results were obtained using a Remix application developed by the "statistics team" and dedicated to the data obtained from images.

II.6 ELISA Assays 5 markers were measured in culture supernatants by using specific ELISA kits: TGF beta 1, VEGF, MMP1, TIMP 1 and CTGF.

III. RESULTS

III.1 Histology

No morphological changes were observed between the different conditions in both studies, indicating than brush does not alter the natural structure of the skin.

III.2 Immunostaining

The immunostaining results are presented below for each biomarker (cutaneous protein) evaluated.

III.2.1 ActinG/ActinF

Dermal fibroblasts exhibit a significant increase in stiffness during aging caused by a progressive shift from monomeric G-actin to polymerized, filamentous F-actin (Schulze et al., *Biophysical Journal* 2010). The ratio between Globular Actin (ActinG) and Fibrillar Actin (Actin F) decrease during aging.

The analysis of this ratio (measured at the same time on the epidermis and on the dermis), at D6 in the first donor and D9 in the second donor, shows:

Brush treatment at 60 Hz increases this ratio in both donors (a significant effect is observed on the first donor and a moderated effect on the second donor, both with a lot of variability);

An effect is observed at 90 and 120 Hz in the first donor, not confirmed in the second donor.

Figure 11:
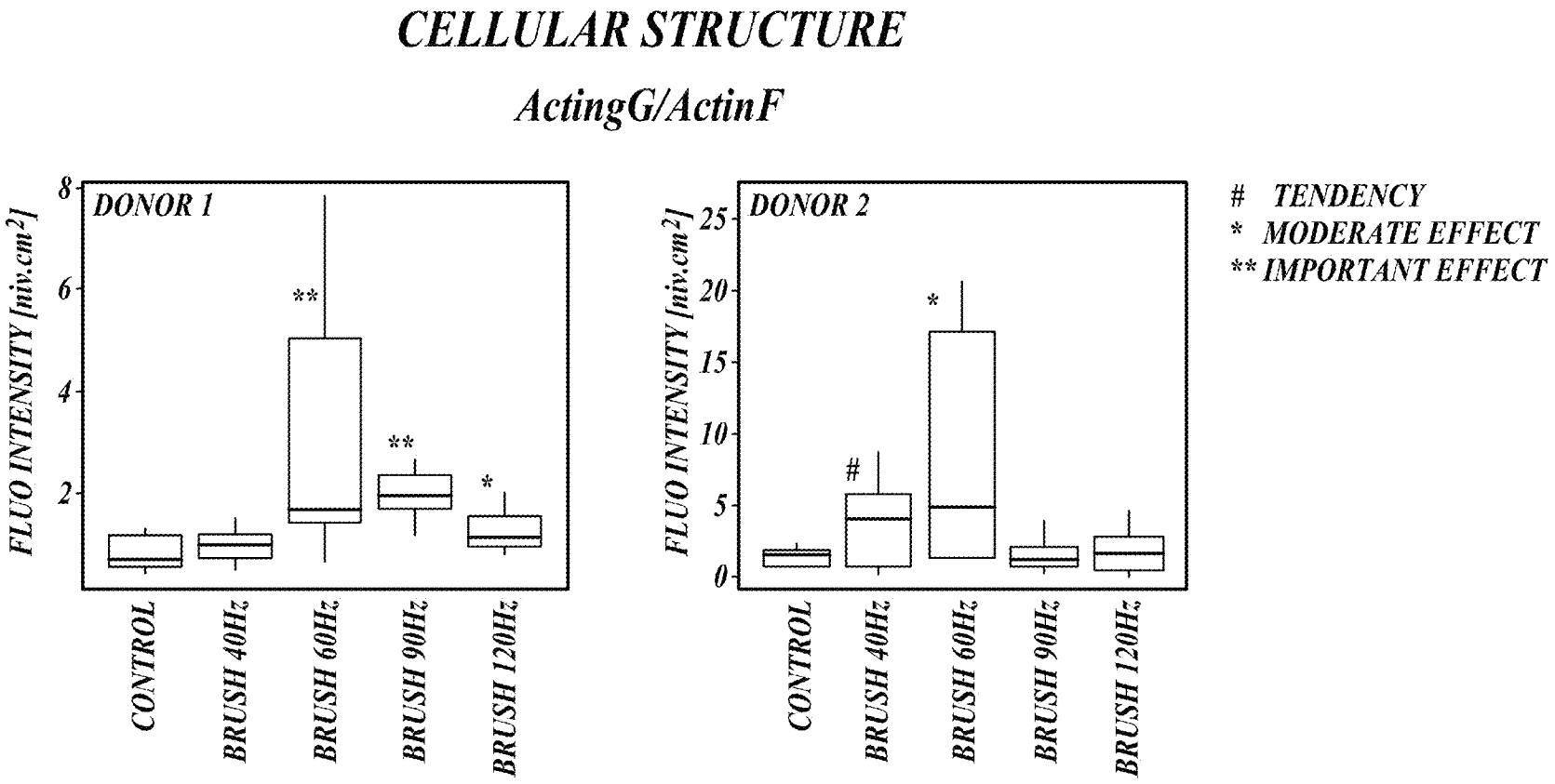
FIGS. 11-17C graphically illustrate experimental cutaneous protein data obtained in accordance with the disclosed embodiments.

FIG. 11 summarizes data for immunolabeling of Actin G and Actin F markers at D6 in the first and D9 in the second study. Box Plot representation of the fluorescence intensity of the markers for each condition tested and statistical analysis of the labeling quantification of each condition, compared with untreated skin.

III.2.2 Filaggrin

The analysis of Filaggrin marker at D6 in the first donor and D9 in the second donor shows:

An increase of the expression of this marker at 60 and 120 Hz treatment in both donors;

A significant effect is observed at 40 Hz treatment in the first donor, but only a tendency is observed in the second donor;

At 90 Hz treatment, a weak increase is observed on both donors.

Figure 12A:
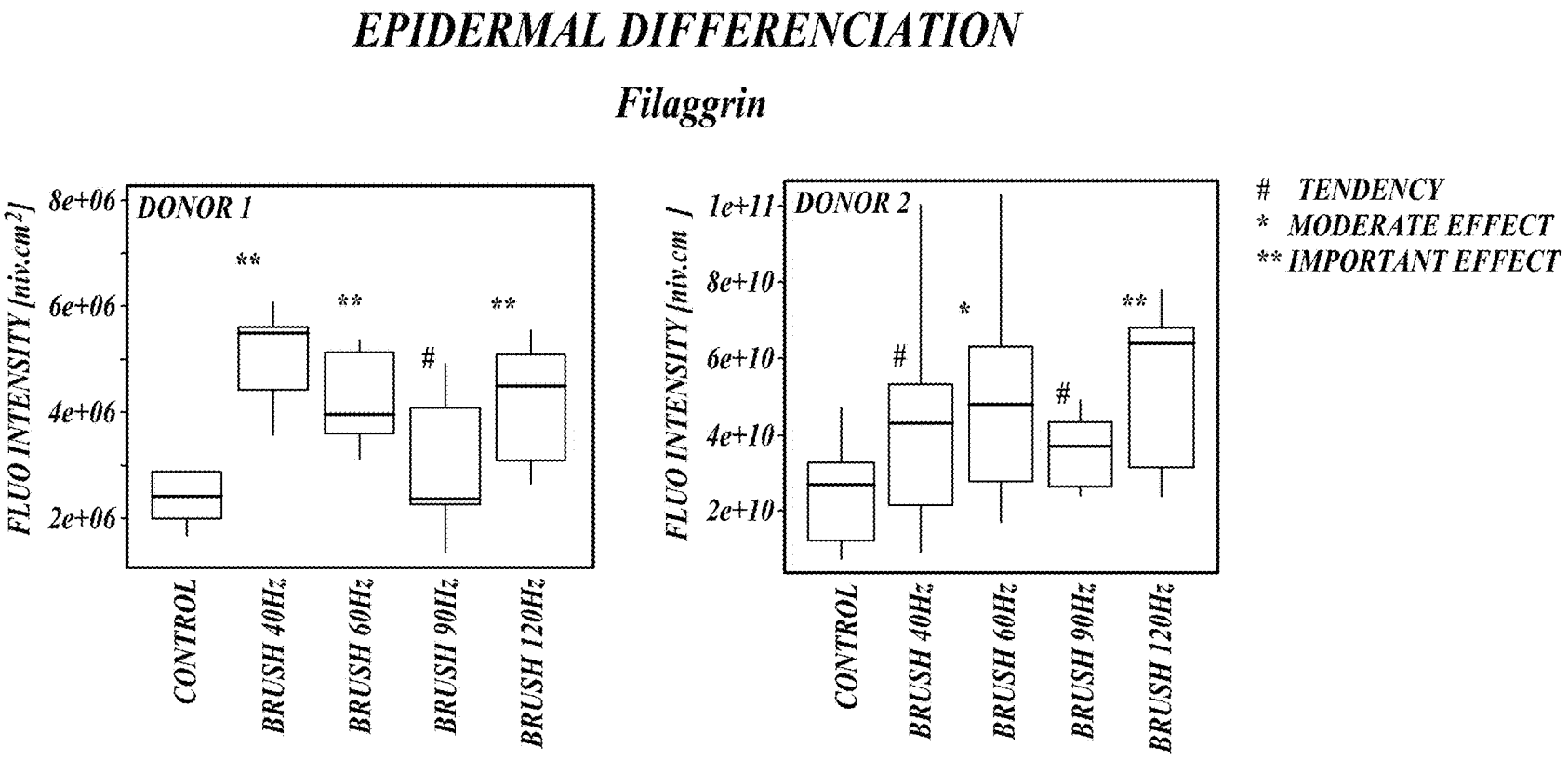

FIG. 12A summarizes data for immunolabeling of the marker at D6 in the first and D9 in the second study. Box Plot representation of the fluorescence intensity of the marker for each condition tested and statistical analysis of the labeling quantification of each condition, compared with untreated skin.

III.2.3 Keratin 10

The analysis of the K10 marker at D6 in the first donor and D9 in the second donor shows:

At 60 Hz: A moderated effect on the first donor confirmed with a significant effect on the second donor were observed.

Figure 12B:
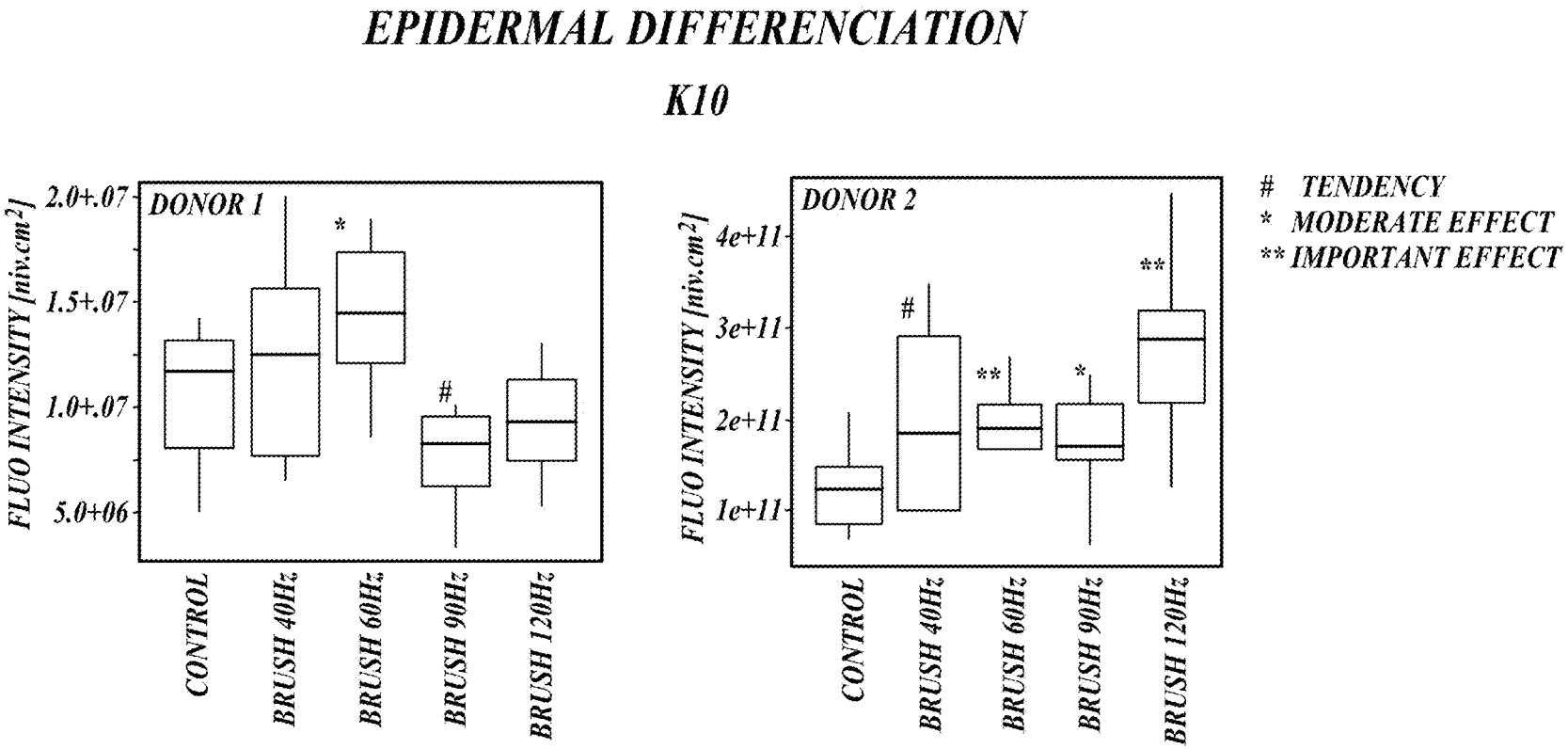

FIG. 12B summarizes data for immunolabeling of the marker at D6 in the first and D9 in the second study. Box Plot representation of the fluorescence intensity of the marker for each condition tested and statistical analysis of the labeling quantification of each condition, compared with untreated skin.

III.2.4 TGK 1

At the epidermis level, the analysis of Transglutaminase 1 (TGK1) marker shows:

At 60 Hz an increase of this marker was observed in both studies (significant in the first study and slight in the second, not confirmed by the statistical analysis, probably because of the strong variability).

Figure 12C:
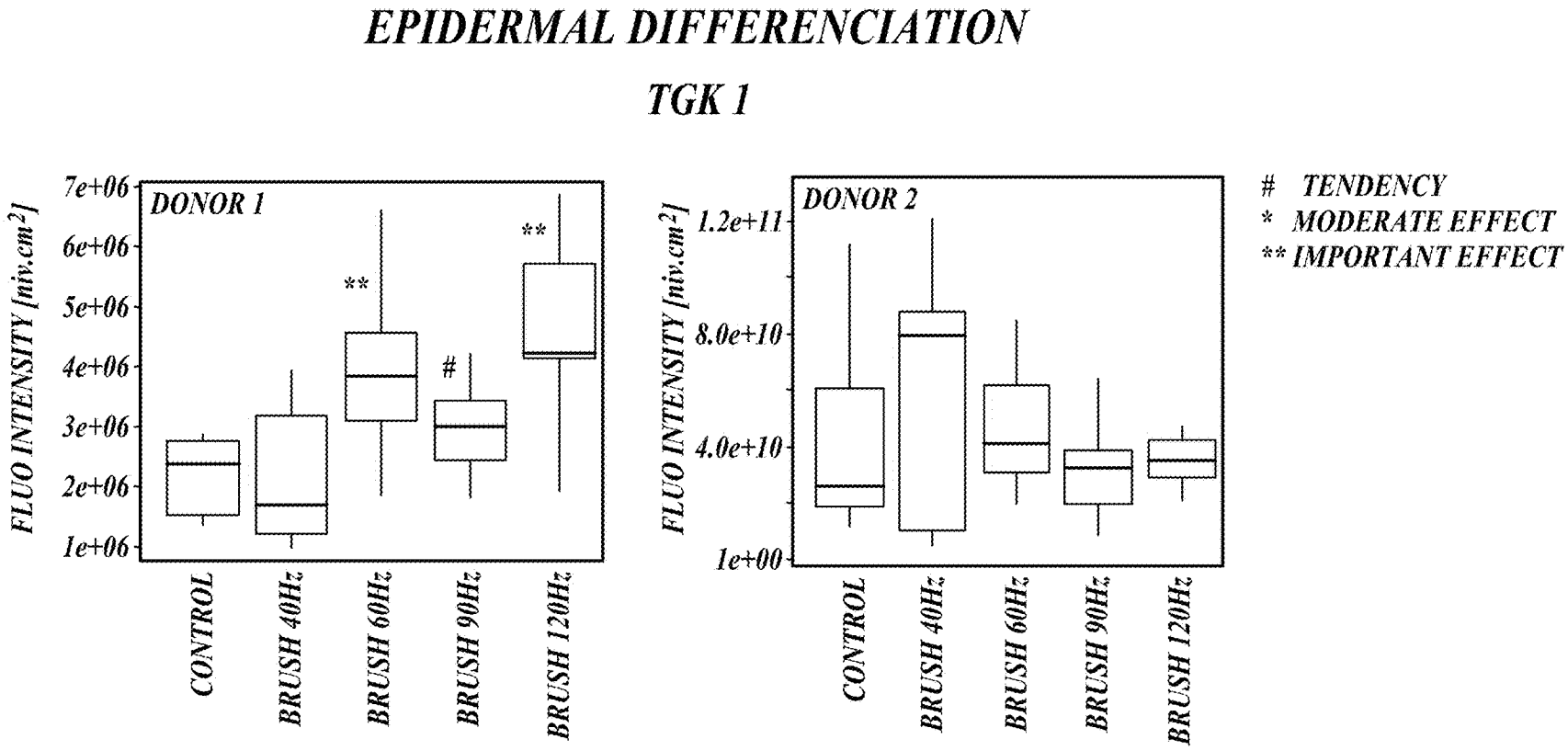

FIG. 12C summarizes data for immunolabeling of the marker at D6 in the first and D9 in the second study. Box Plot representation of the fluorescence intensity of the marker for each condition tested and statistical analysis of the labeling quantification of each condition, compared with untreated skin.

III.2.5 Tenascin C

The analysis of Tenascin C marker at D6 in the first donor and D9 in the second donor shows:

A significant increase of the expression of this marker at 90 Hz in the first study, only confirmed by a tendency on the second study.

Figure 13A:
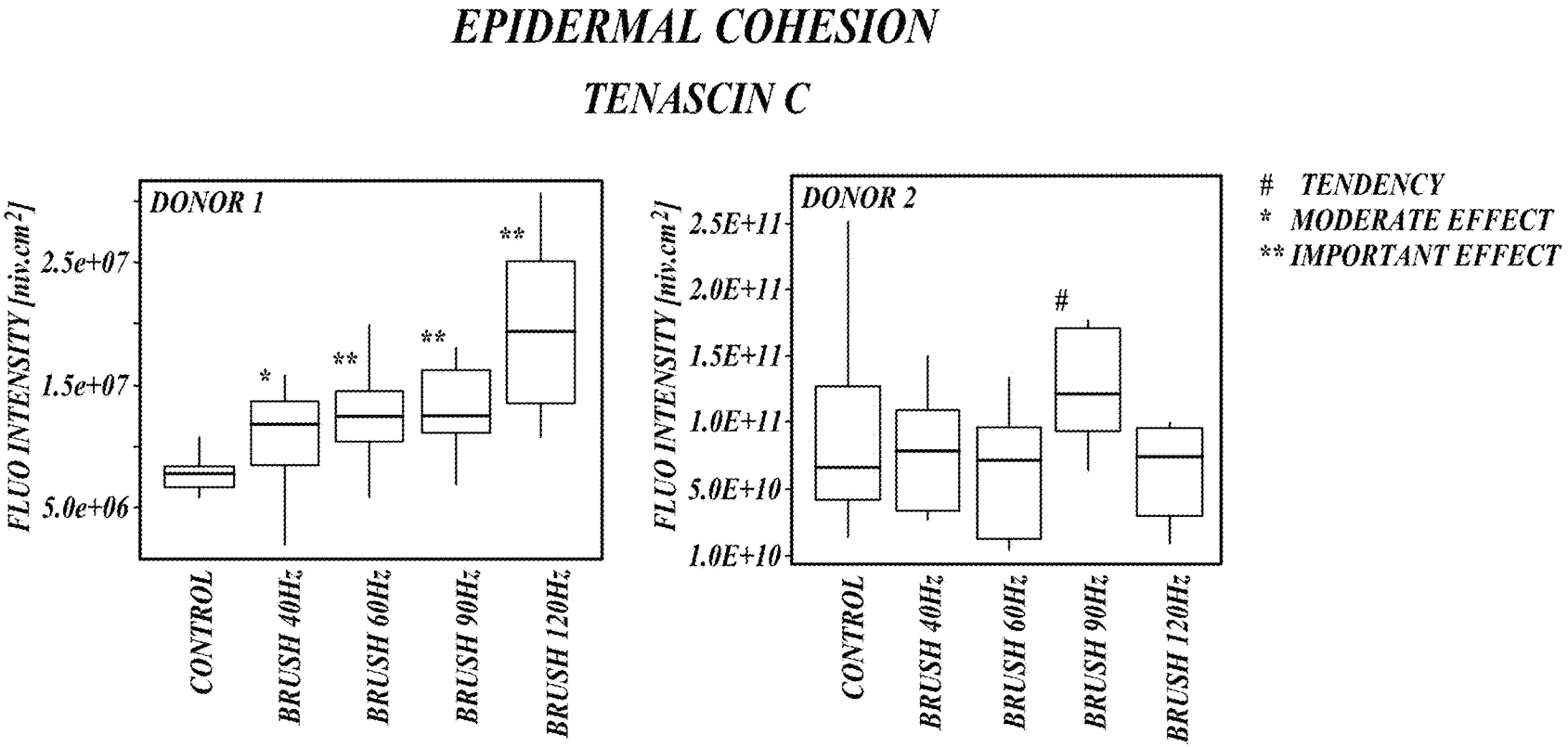

FIG. 13A summarizes data for immunolabeling of the marker at D6 in the first and D9 in the second study. Box Plot representation of the fluorescence intensity of the marker for each condition tested and statistical analysis of the labeling quantification of each condition, compared with untreated skin.

III.2.6 CD44

The analysis of CD44 marker at D6 in the first donor and D9 in the second donor shows:

A moderated increase of the expression of this marker at 40 Hz in the first study confirmed with only a tendency in the second study;

A moderated increase at 60 and 90 Hz in both studies;

A significant increase at 120 Hz the first study confirmed with only a tendencies in the second study.

Figure 13B:
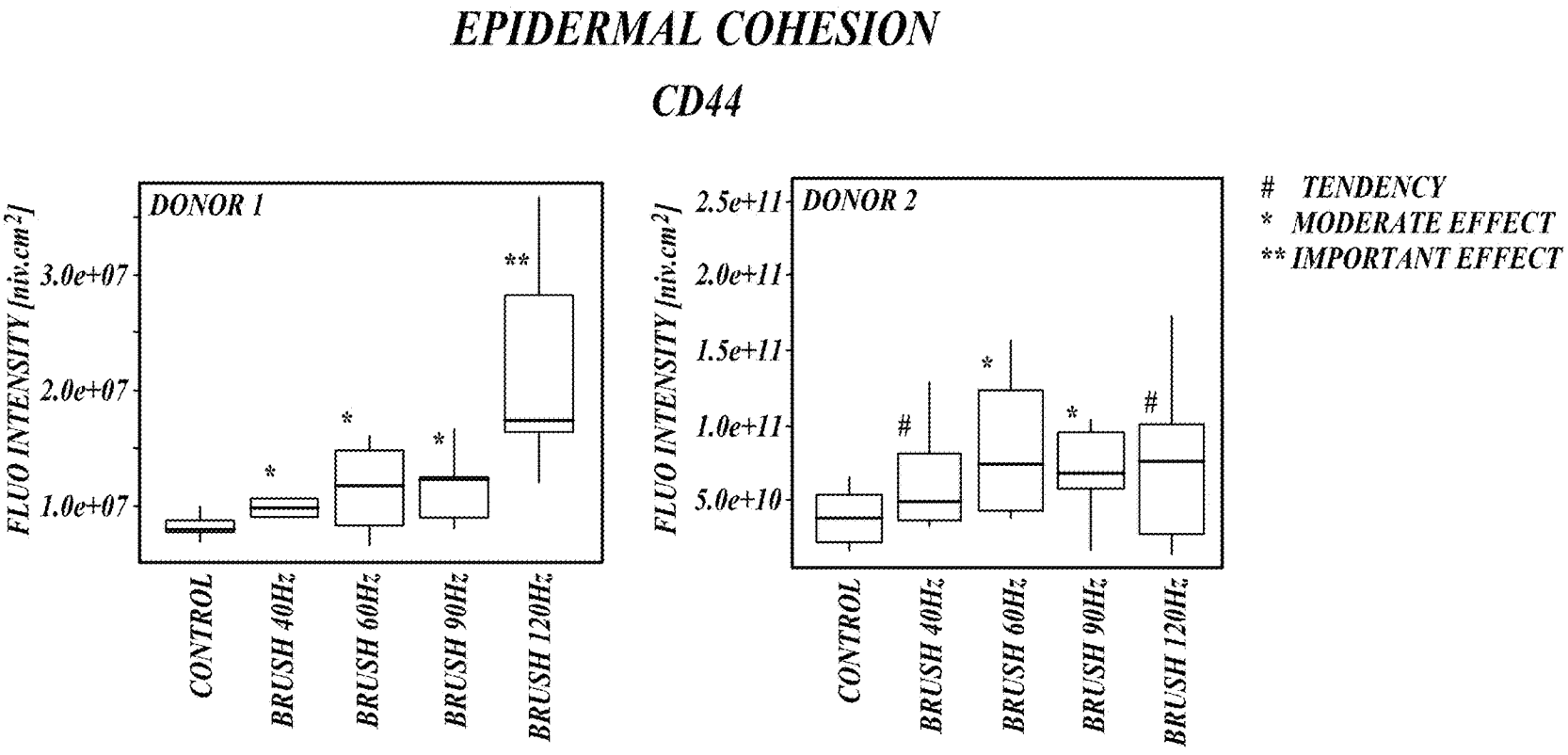

FIG. 13B summarizes data for immunolabeling of the marker at D6 in the first and D9 in the second study. Box Plot representation of the fluorescence intensity of the marker for each condition tested and statistical analysis of the labeling quantification of each condition, compared with untreated skin.

III.2.7 Keratin 14

The analysis of K14 marker at D6 in the first donor and D9 in the second donor shows:

A significant increase at 60 Hz in the first donor and a slight increase in the second donor (not confirmed in the second study by the statistical analysis);

A significant increase at 120 Hz in the second donor.

Figure 14A:
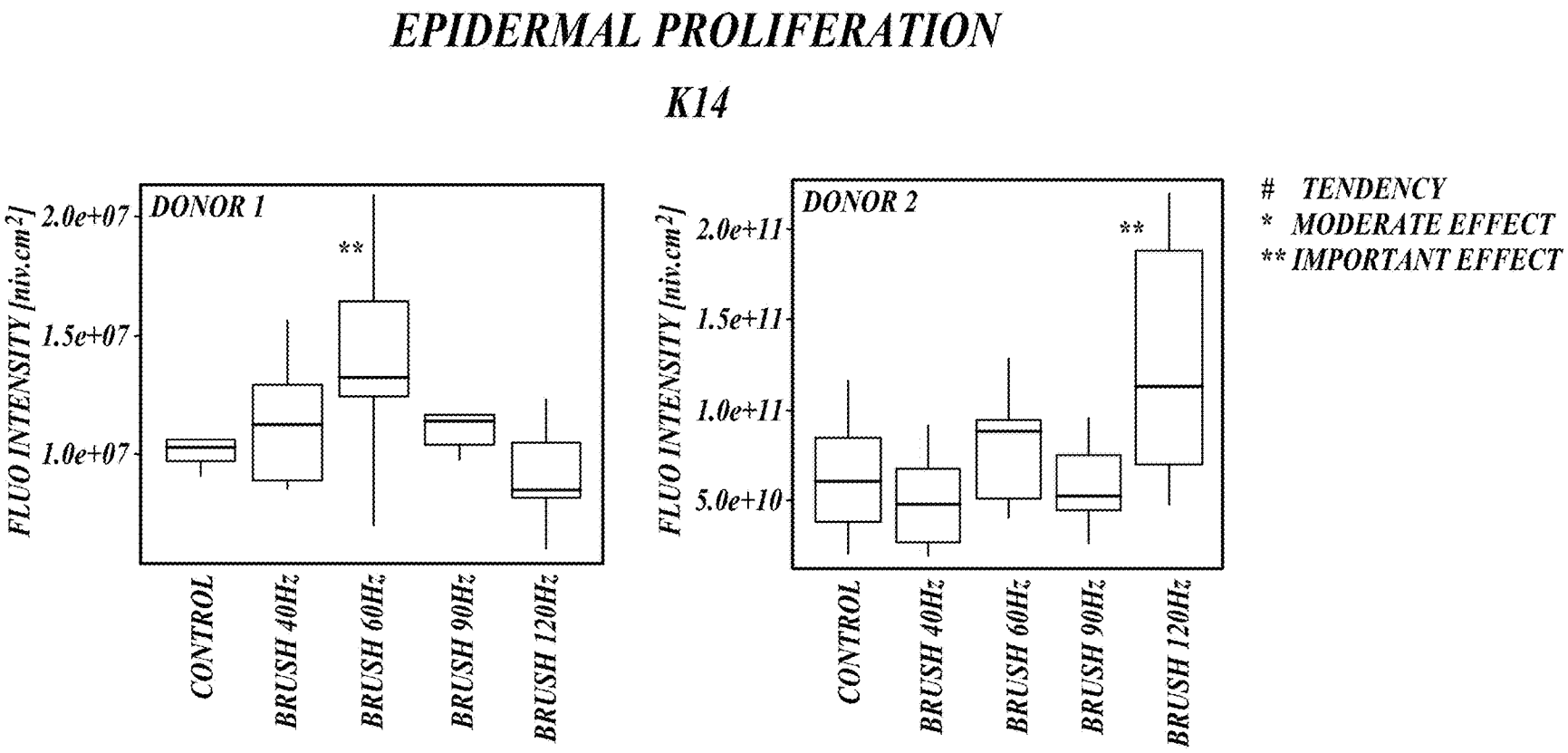

FIG. 14A summarizes data for immunolabeling of the marker at D6 in the first and D9 in the second study. Box Plot representation of the fluorescence intensity of the marker for each condition tested and statistical analysis of the labeling quantification of each condition, compared with untreated skin.

III.2.8 Syndecan 1

The analysis of Syndecan 1 marker at D6 in the first donor and D9 in the second donor shows:

A significant increase of the expression of this marker at 60-90-120 Hz in the first study, confirmed with tendencies (for the 60 and 90 Hz) or moderated effect (for the 120 Hz) in the second study;

After 40 Hz treatment, only a slight effect was observed in the first study.

Figure 14B:
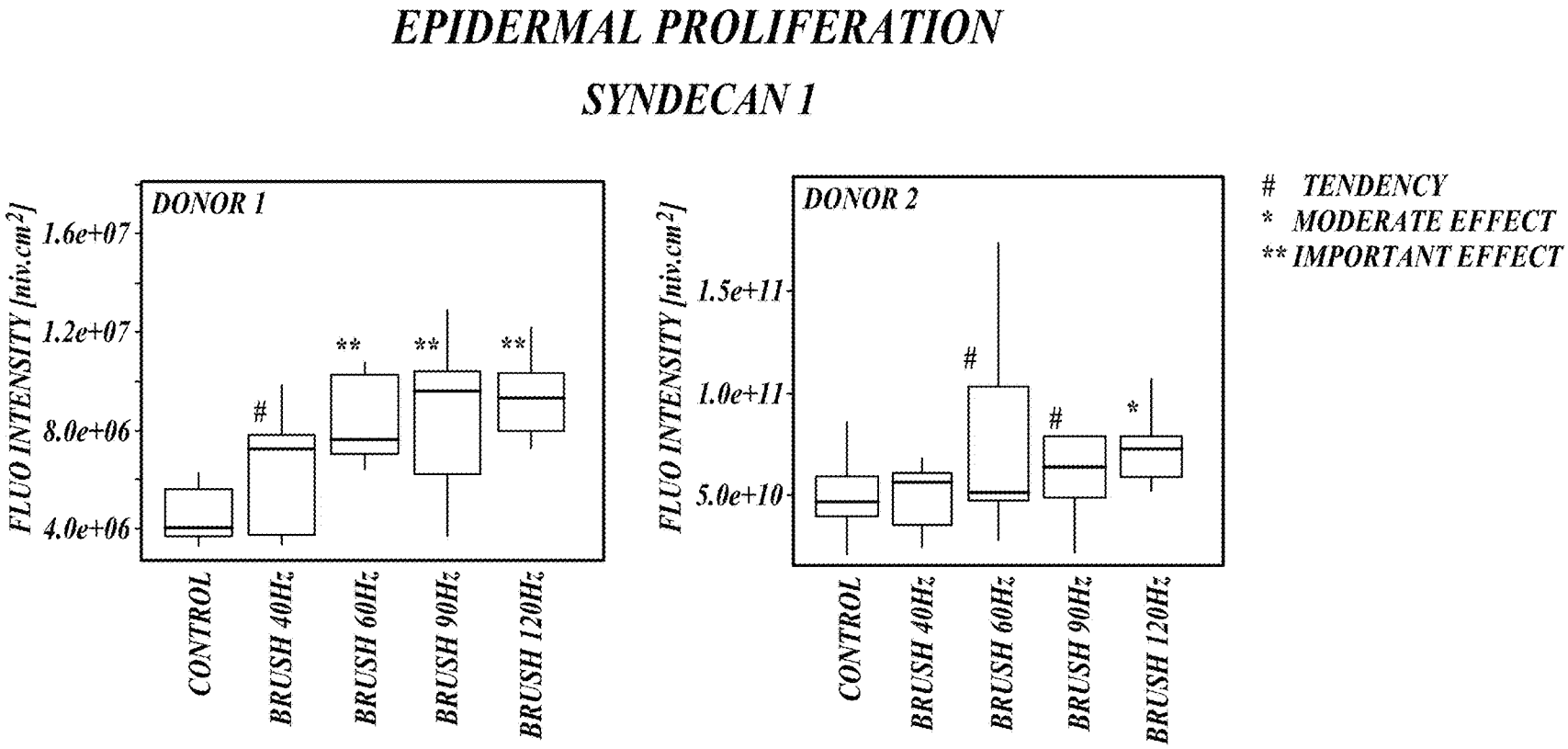

FIG. 14B summarizes data for immunolabeling of the marker at D6 in the first and D9 in the second study. Box Plot representation of the fluorescence intensity of the marker for each condition tested and statistical analysis of the labeling quantification of each condition, compared with untreated skin.

III.2.9 Collagen 4

The analysis of Collagen 4 marker at D6 in the first donor and D9 in the second donor shows:

A strong effect at 40 Hz and 60 Hz in the second study;

A moderated effect at 90 Hz in the first study confirmed with a significant effect on the second;

A significant increase at 120 Hz in both studies.

Figure 15A:
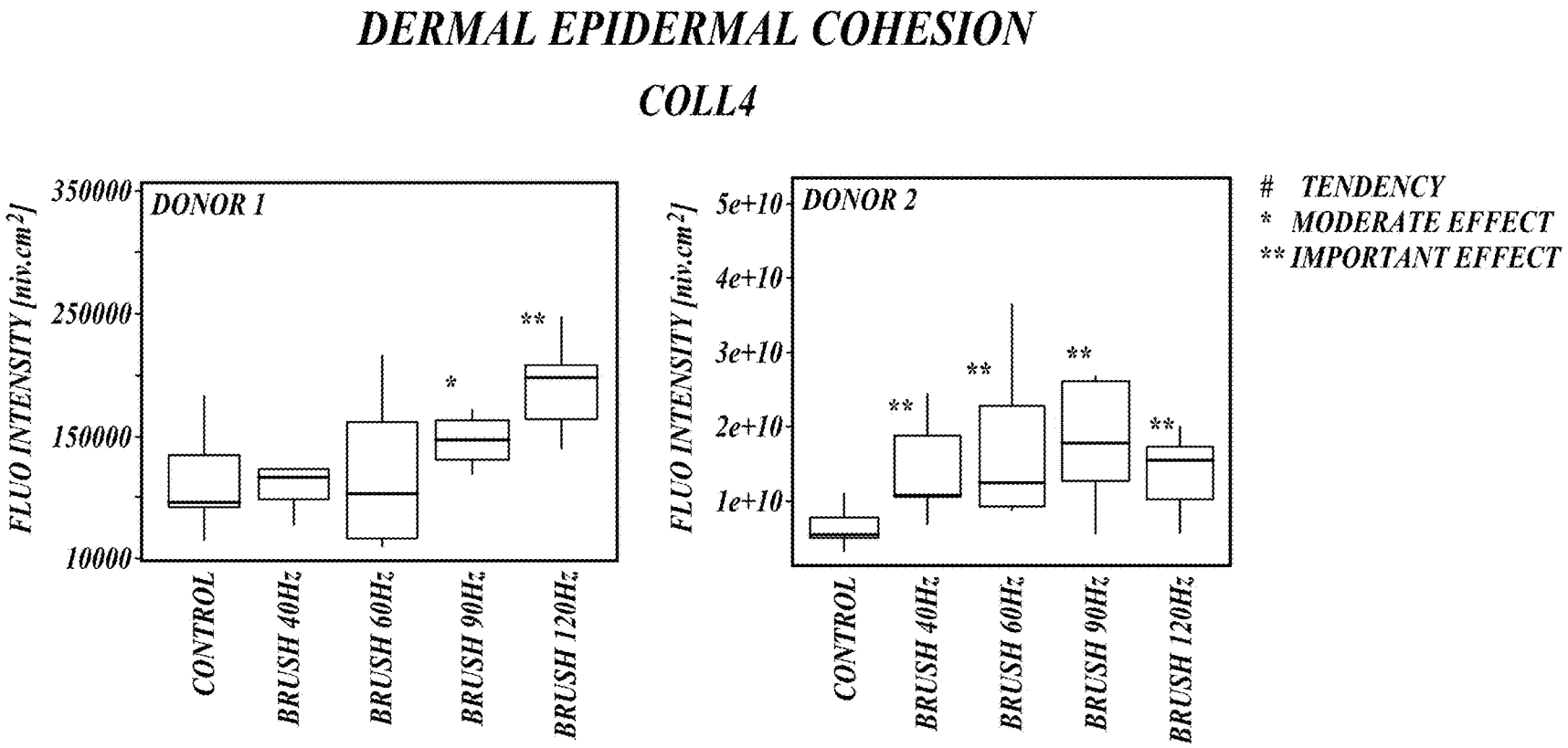

FIG. 15A summarizes data for immunolabeling of the marker at D6 in the first and D9 in the second study. Box Plot representation of the fluorescence intensity of the marker for each condition tested and statistical analysis of the labeling quantification of each condition, compared with untreated skin.

III.2.10 Perlecan

The analysis of Perlecan marker at D6 in the first donor and D9 in the second donor shows:

A significant increase of the expression of this marker after the 60 Hz treatment in both studies.

Figure 15B:
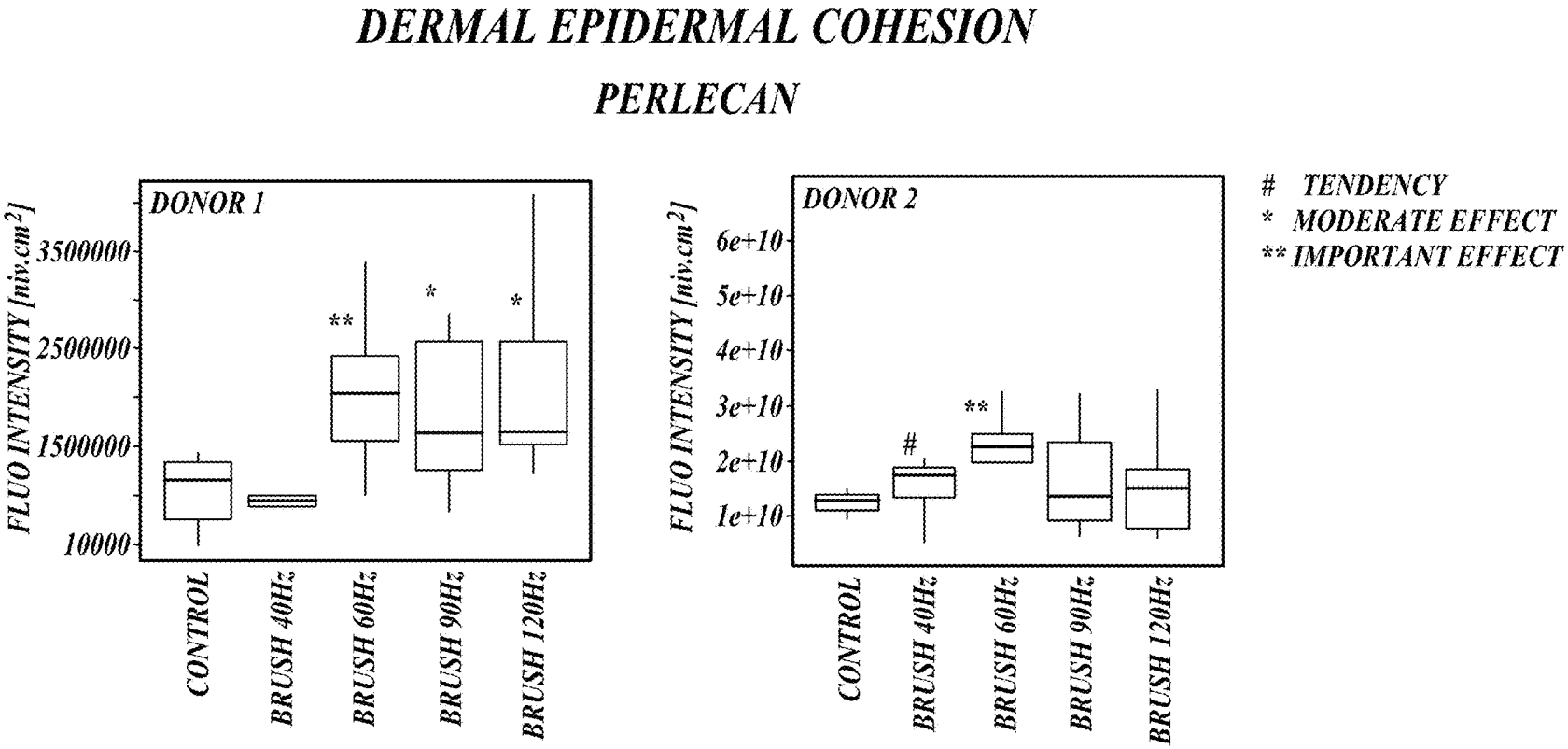

FIG. 15B summarizes data for immunolabeling of the marker at D6 in the first and D9 in the second study. Box Plot representation of the fluorescence intensity of the marker for each condition tested and statistical analysis of the labeling quantification of each condition, compared with untreated skin.

III.2.11 Collagen 7

Figure 15C:
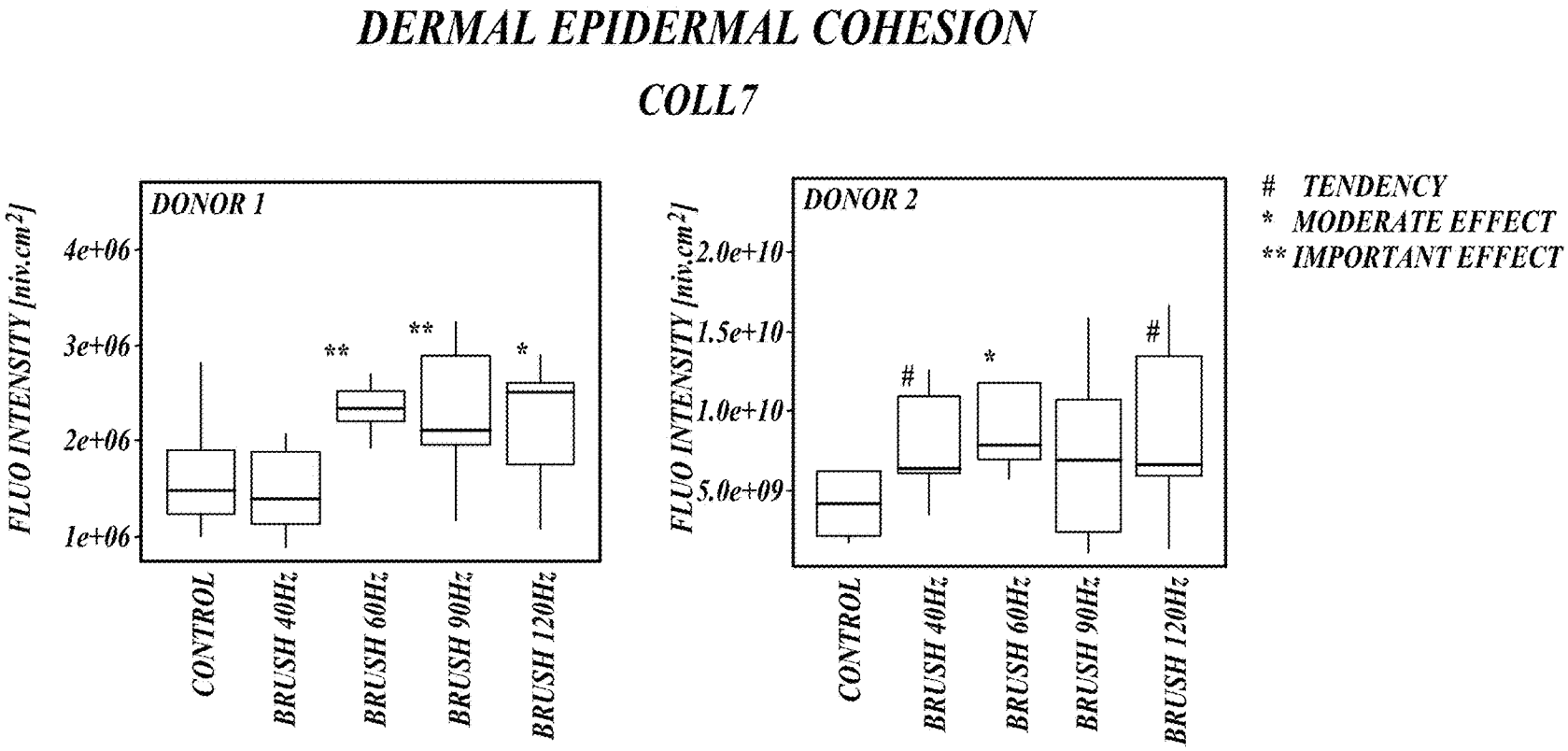

The analysis of Collagen 7 marker at D6 in the first donor and D9 in the second donor shows:

A significant increase of the expression of Coll 7 marker after 60 Hz treatment on the first study confirmed in the second study by a moderated effect;

A moderated effect after 120 Hz treatment on the first study, but in the second study only a slight increase is observed (tendency);

FIG. 15C summarizes data for immunolabeling of the marker at D6 in the first and D9 in the second study. Box Plot representation of the fluorescence intensity of the marker for each condition tested and statistical analysis of the labeling quantification of each condition, compared with untreated skin.

III.2.12 Laminin 5

The analysis of Laminin 5 marker at D6 in the first donor and D9 in the second donor shows:

- A significant increase of the expression of Laminin 5 marker after 60 Hz treatment on the first study confirmed in the second study by a moderated effect;
- A significant effect after 90 Hz treatment in the first study, but in the second study only a slight increase is observed (tendency);
- A moderated effect after 120 Hz treatment is observed in the first study;

No effect observed after 40 Hz treatment in both studies.

Figure 15D:
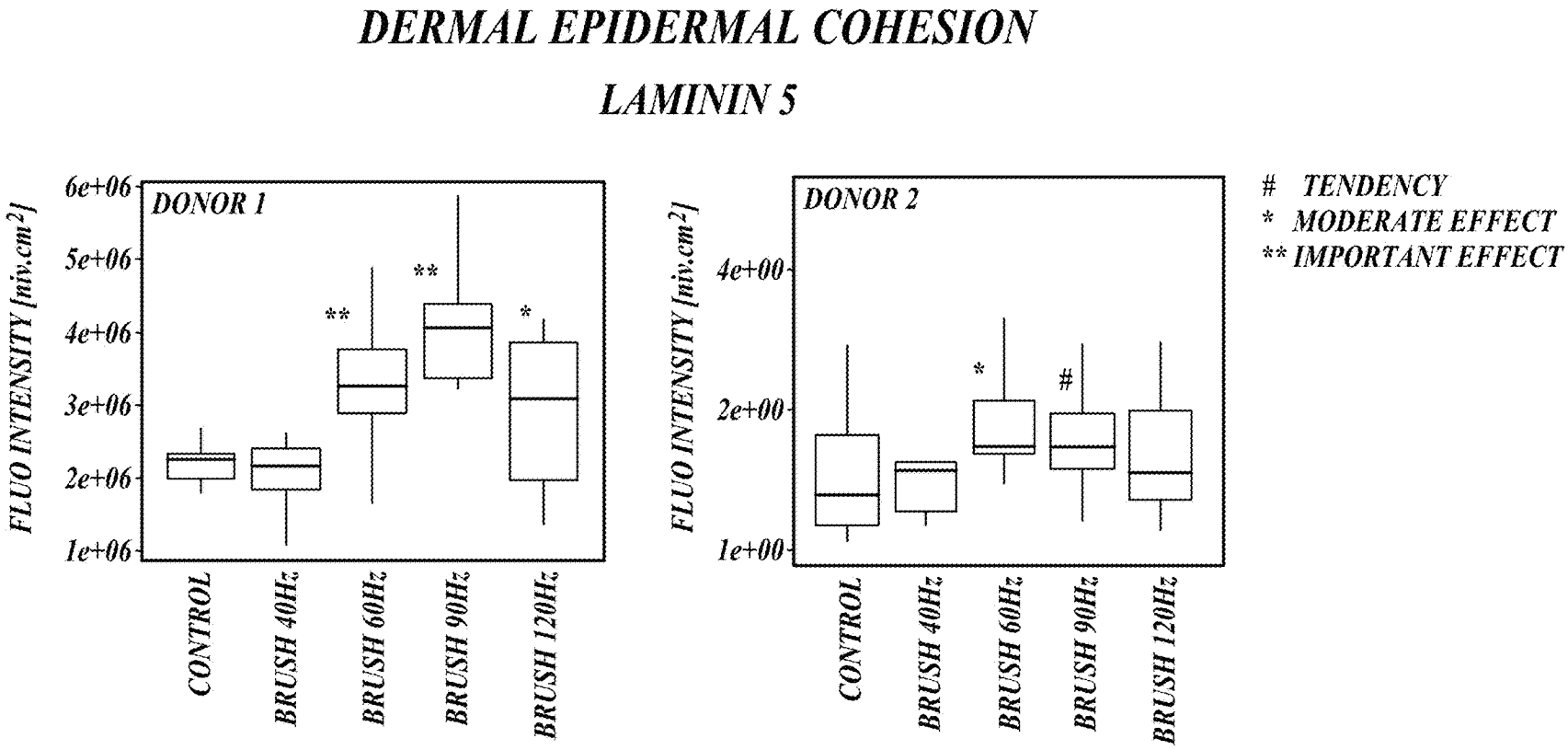

FIG. 15D summarizes data for immunolabeling of the marker at D6 in the first and D9 in the second study. Box Plot representation of the fluorescence intensity of the marker for each condition tested and statistical analysis of the labeling quantification of each condition, compared with untreated skin.

III.2.13 Procollagen 1

The analysis of Procollagen 1 marker at D6 in the first donor and D9 in the second donor shows:

No effect after the 40 Hz treatment;

- A significant increase of the expression of Procoll 1 marker after 60 Hz treatment in the first study confirmed in the second study by a moderated effect;
- A significant effect after 120 Hz treatment in the first study, but in the second study only a slight increase is observed (tendency);
- A significant effect after 90 Hz treatment is observed in the first study.

Figure 16A:
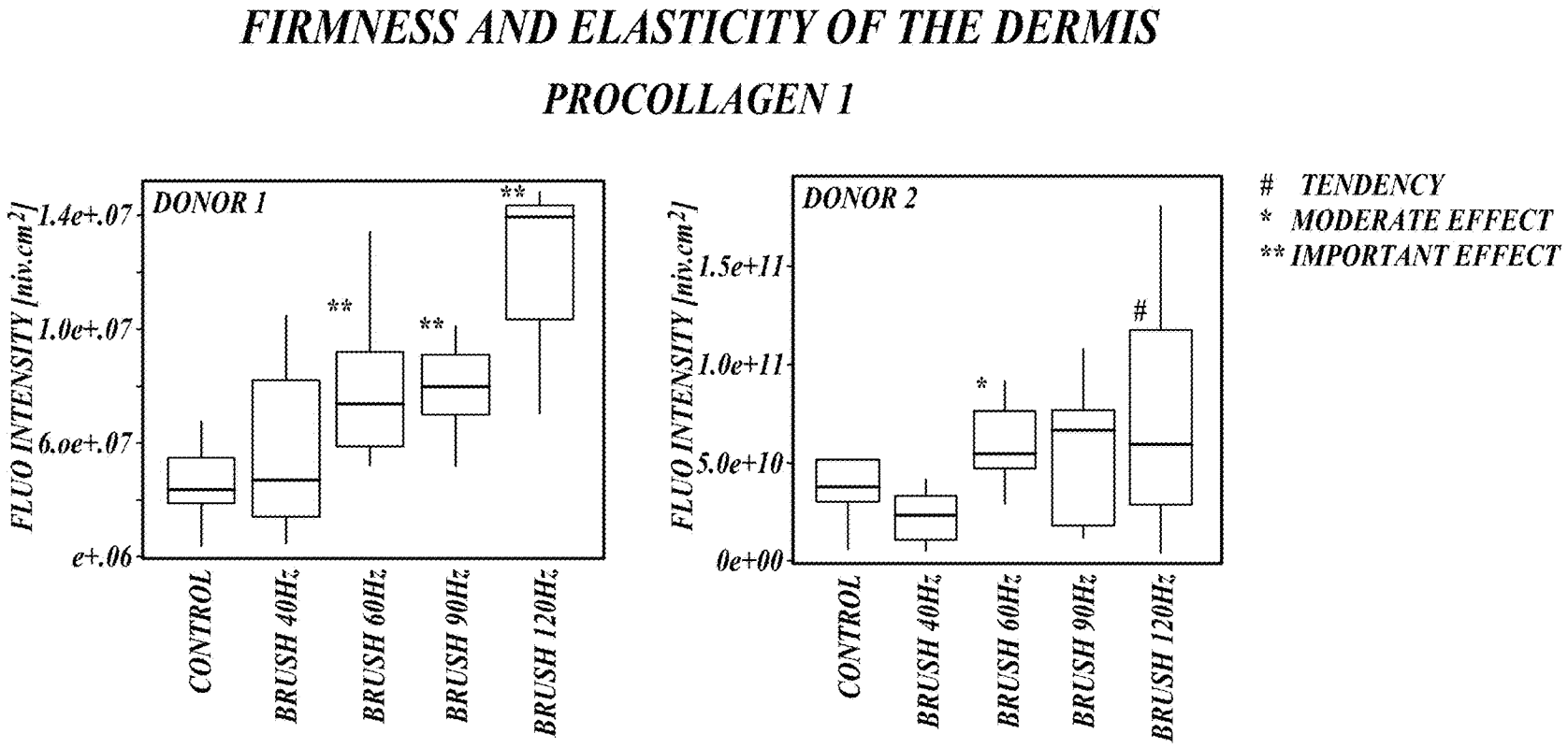

FIG. 16A summarizes data for immunolabeling of the marker at D6 in the first and D9 in the second study. Box Plot representation of the fluorescence intensity of the marker for each condition tested and statistical analysis of the labeling quantification of each condition, compared with untreated skin.

III.2.14 Tropoelastin

The analysis of Tropoelastin marker at D6 in the first donor and D9 in the second donor shows:

No effect after the 40 Hz treatment in both studies;

- A moderated effect after 60 Hz treatment in the first study;
- A slight effect (tendencies) after 90 Hz treatment in both studies;
- A moderated effect after 120 Hz treatment in the second studies.

Figure 16B:
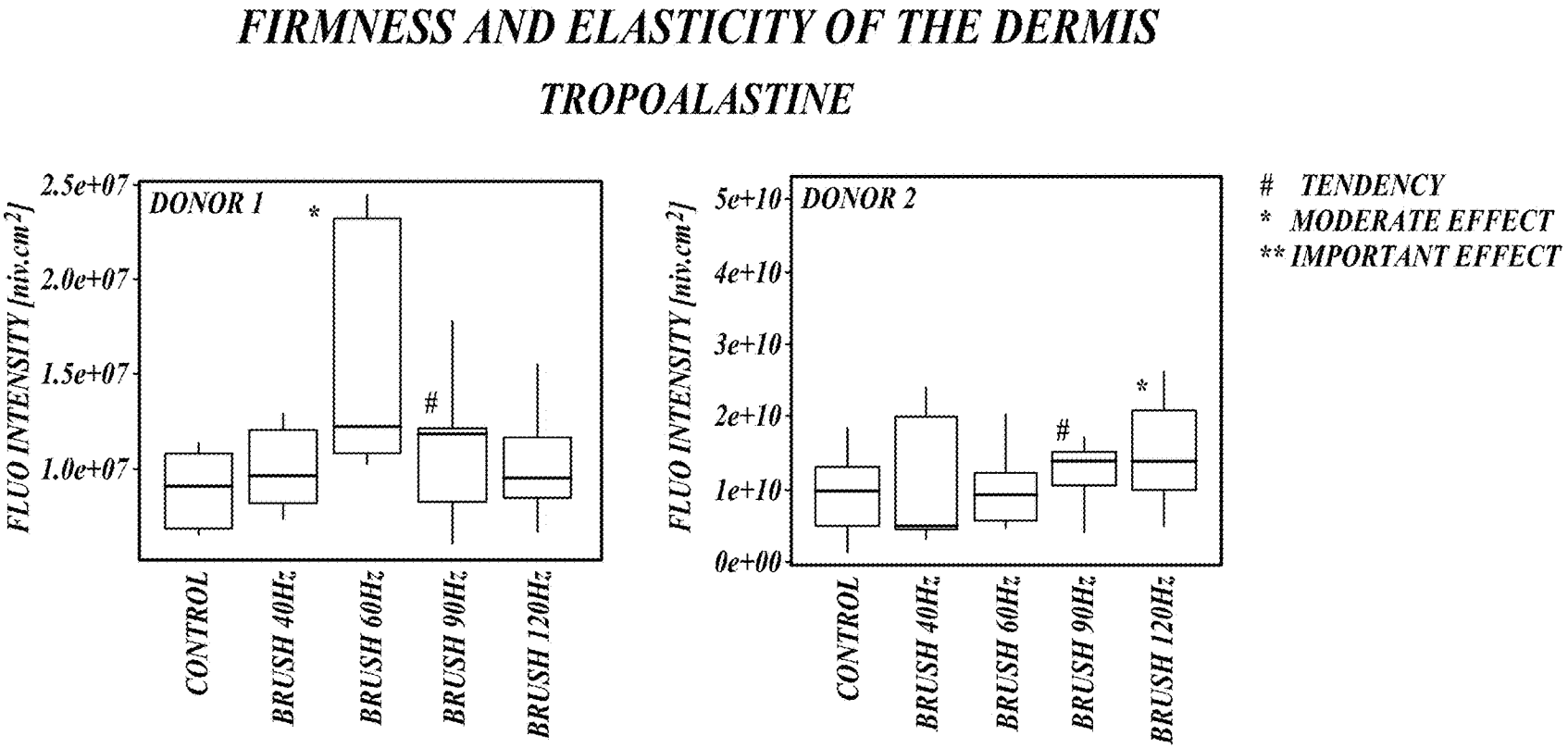

FIG. 16B summarizes data for immunolabeling of the marker at D6 in the first and D9 in the second study. Box Plot representation of the fluorescence intensity of the marker for each condition tested and statistical analysis of the labeling quantification of each condition, compared with untreated skin.

III.2.15 HAS3

The analysis of HAS3 marker at D6 in the first donor and D9 in the second donor shows:

- A moderated increase of the expression of HAS3 marker after 40 Hz treatment in both studies;
- Significant increase on the expression of this marker in the first study after 60 Hz treatment; in the second study a slight increase is observed;
- A significant increase after 90 Hz treatment in the first study confirmed by a moderated effect in the second study;
- A significant increase after 120 Hz treatment in the first study.

Figure 17A:
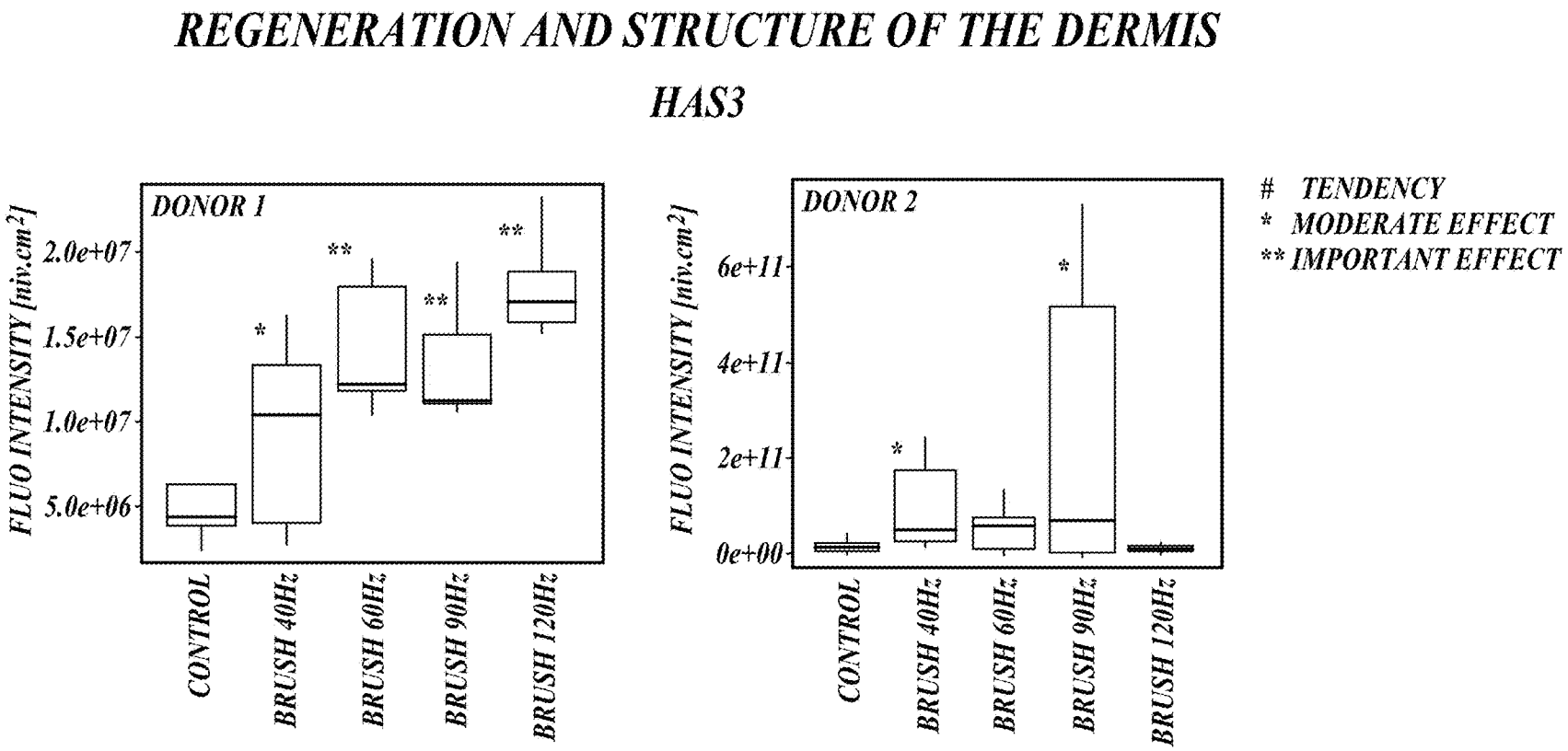

FIG. 17A summarizes data for immunolabeling of the marker at D6 in the first and D9 in the second study. Box Plot representation of the fluorescence intensity of the marker for each condition tested and statistical analysis of the labeling quantification of each condition, compared with untreated skin.

III.2.16 Fibronectin

The analysis of Fibronectin marker at D6 in the first donor and D9 in the second donor shows:

- A significant increase of the expression of this marker after 60 Hz treatment in both studies;
- A slight effect (tendency) after 90 Hz treatment in both studies.

Figure 17B:
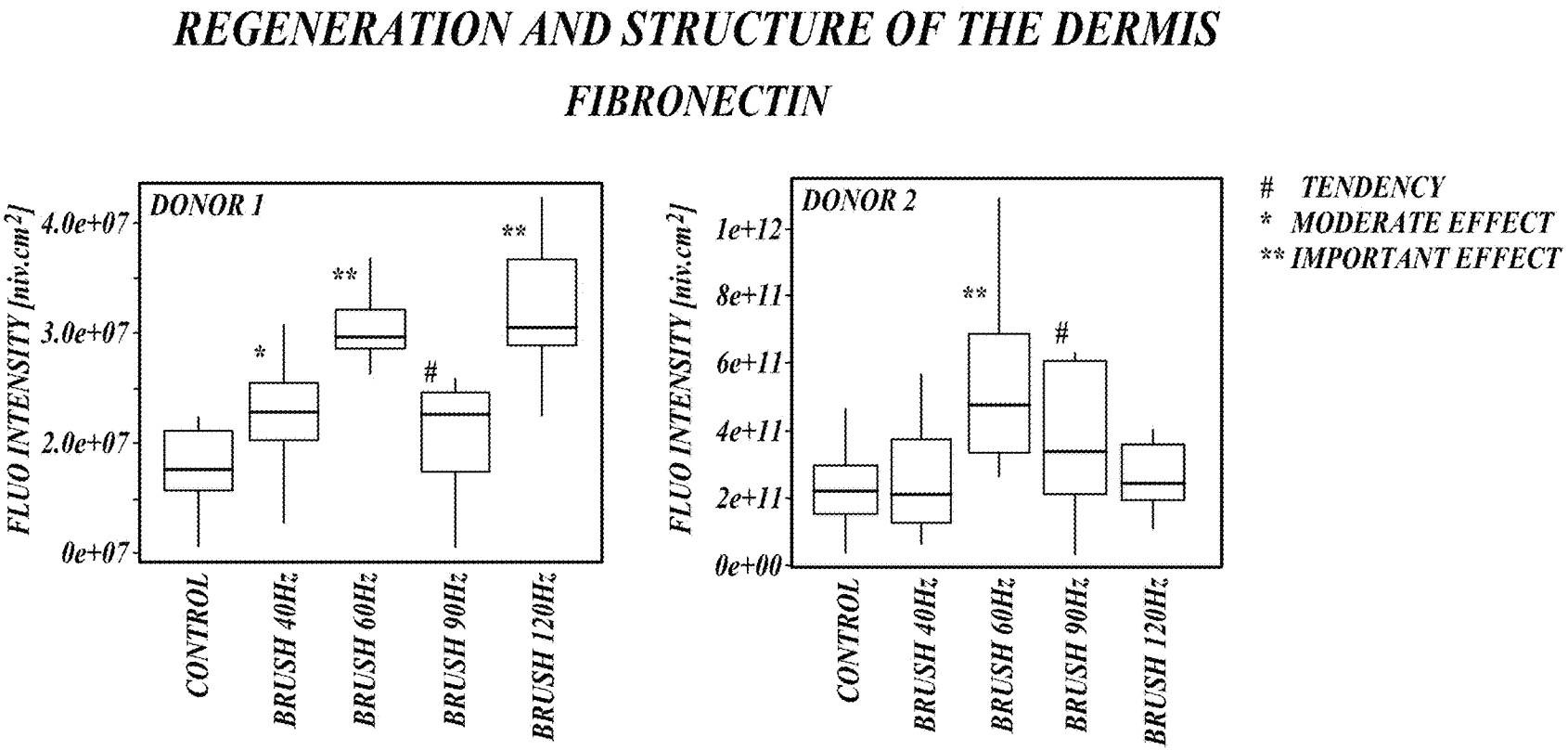

FIG. 17B summarizes data for immunolabeling of the marker at D6 in the first and D9 in the second study. Box Plot representation of the fluorescence intensity of the marker for each condition tested and statistical analysis of the labeling quantification of each condition, compared with untreated skin.

III.2.17 Integrin β1

Figure 17C:
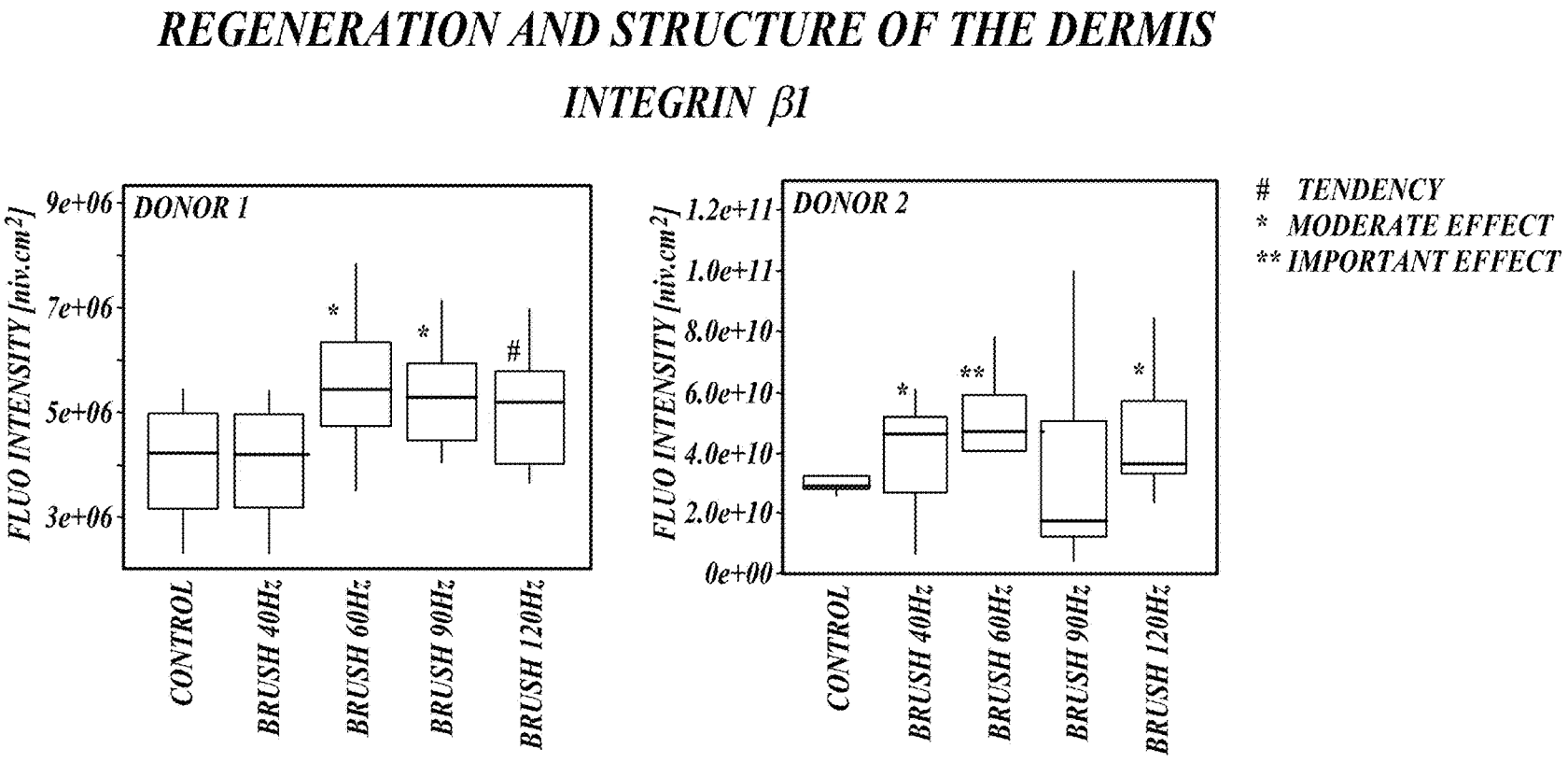

The analysis of Integrin β1 marker at D6 in the first donor and D9 in the second donor shows:

- An increase of the expression of this marker after 60 Hz treatment (moderated in the first study and significant in the second);
- An increase of the expression of this markers after 120 Hz (slight increase in the first study, moderated in the second);

FIG. 17C summarizes data for immunolabeling of the marker at D6 in the first and D9 in the second study. Box Plot representation of the fluorescence intensity of the marker for each condition tested and statistical analysis of the labeling quantification of each condition, compared with untreated skin.

III.3 Soluble Markers

The total results of the soluble markers MMP1 analyzed are illustrated in FIG. 2. MMP1 was upregulated at 40 Hz and with the Mia Brush at 176 Hz. No significant differences were observed between both studies.

IV. CONCLUSIONS

In these two studies, we analyzed the effects of different frequencies of the brush treatment in a human skin model. FIG. 2 is a summary of the results obtained from the two studies compared with the results obtained with the Clarisonic Mia Brush. The shading and arrows indicate the global intensity of the effect. No shading and no arrow indicate no effect confirmed in both studies.

While illustrative embodiments have been illustrated and described, it will be appreciated that various changes can be made therein without departing from the spirit and scope of the invention.

The embodiments of the invention in which an exclusive property or privilege is claimed are defined as follows:

1. A method for modulating one or more cutaneous proteins, the method comprising the steps of:

applying a mechanical strain to a portion of skin for a duration sufficient to affect upregulation of one or more epidermis-associated proteins or dermoepidermal-junction-associated proteins without substantially affecting upregulation of one or more or dermis-associated proteins in the portion of skin, wherein the step of applying the mechanical strain to a portion of skin includes applying a cyclical mechanical strain having a peak cyclic or oscillation frequency ranging from about 100 hertz to about 140 hertz for a duration sufficient to affect upregulation of one or more epidermis-associated proteins or dermoepidermal-junction-associated proteins without substantially affecting upregulation of one or more or dermis-associated proteins in the portion of skin; and wherein the step of applying the mechanical strain to a portion of skin includes using an appliance, wherein the appliance includes: a controller for selecting the peak cyclic or oscillation frequency; a motor; and a workpiece operably coupled to the motor, the workpiece including a plurality of contact points at which the workpiece is configured to contact the portion of skin;

wherein the plurality of contact points are located at a distance from each other that is based on an inverse of the selected peak cyclic or oscillation frequency;

wherein the motor is configured to move the workpiece, and wherein the appliance is configured such that, when the motor is moving the workpiece, the appliance has a resonant frequency based on the selected peak cyclic or oscillation frequency;

wherein, when the motor is operating and a force is applied to the appliance to bias the workpiece against the portion of skin, the workpiece produces a cyclical stimulus within the portion of skin at the selected peak cyclic or oscillation frequency.

2. The method of claim 1, wherein the one or more epidermis-associated or dermoepidermal-junction-associated proteins are selected from the group consisting of filaggrin; transglutaminase 1 (TGK1); glycoprotein (CD44); keratin 10 (K10); keratin 14 (K14); tenacin C; globular actin (ActinG); fibrillar actin (ActinF); syndecan 1; collagen 4 (Coll 4); collagen 7 (Coll 7); laminin V; and perlecan; without substantially affecting upregulation of one or more dermis-associated proteins selected from the group consisting of hyaluronan synthase 3 (HAS3); fibronectin; tropoelastin; procoll1; integrin; and decorin.

3. The method of claim 1, wherein the one or more epidermis-associated or dermoepidermal-junction-associated proteins are selected from the group consisting of filaggrin; transglutaminase 1 (TGK1); glycoprotein (CD44); keratin 10 (K10); keratin 14 (K14); tenacin C; syndecan 1; collagen 4 (Coll 4); and collagen 7 (Coll 7); without substantially affecting upregulation of one or more dermis-associated proteins selected from the group consisting of hyaluronan synthase 3 (HAS3); fibronectin; tropoelastin; and decorin.

4. The method of claim 1, wherein the step of applying the mechanical strain to a portion of skin includes the workpiece being selected from the group consisting of a brush and an applicator.

5. The method of claim 1, wherein the step of applying the mechanical strain to a portion of skin includes moving the workpiece in a motion selected from the group consisting of oscillation, vibration, reciprocation, rotation, cyclical, and combinations thereof.

6. The method of claim 1, wherein the step of applying the mechanical strain to a portion of skin includes moving the workpiece in an angular oscillatory motion.

7. The method of claim 1, wherein the step of applying the mechanical strain to a portion of skin includes the portion of skin being substantially equal in size to a contact area of the workpiece configured to contact the portion of skin.

8. The method of claim 1, wherein the step of applying the mechanical strain to a portion of skin includes applying an application force normal to the potion portion of skin and applying a mechanical shear force in a plane of the portion of skin.

9. The method of claim 1, wherein the step of applying the mechanical strain to a portion of skin includes the duration being about 1 minute to about 5 minutes, wherein the step of applying the mechanical strain to a portion of skin includes applying the mechanical strain to the portion of skin without substantial interruption during the treatment time period.

* * * * *